US011761335B1

(12) United States Patent
Pan et al.

(10) Patent No.: US 11,761,335 B1
(45) Date of Patent: Sep. 19, 2023

(54) DETERMINING METHOD FOR BURSTING-PREVENTING PARAMETER OF ROADWAY SUPPORT FOR ROCK BURST IN COAL MINE, AND SYSTEM THEREOF

(71) Applicant: LIAONING UNIVERSITY, Shenyang (CN)

(72) Inventors: Yishan Pan, Shenyang (CN); Lianpeng Dai, Shenyang (CN); Aiwen Wang, Shenyang (CN); Jun Liu, Shenyang (CN)

(73) Assignee: LIAONING UNIVERSITY, Shenyang (CN)

( * ) Notice: Subject to any disclaimer, the term of this patent is extended or adjusted under 35 U.S.C. 154(b) by 0 days.

(21) Appl. No.: 18/311,525

(22) Filed: May 3, 2023

(30) Foreign Application Priority Data

Oct. 25, 2022 (CN) ..... 202211311397.7

(51) Int. Cl.
*E21F 17/18* (2006.01)

(52) U.S. Cl.
CPC ..... *E21F 17/185* (2013.01)

(58) Field of Classification Search
None
See application file for complete search history.

(56) References Cited

U.S. PATENT DOCUMENTS 7,872,580 B2 * 1/2011 Dorfner ..... E01C 11/16 340/572.1
2021/0097417 A1 * 4/2021 Petladwala ..... G06N 7/01

* cited by examiner

*Primary Examiner* — Brandi N Hopkins
*Assistant Examiner* — Nigel H Plumb
(74) *Attorney, Agent, or Firm* — Sughrue Mion, PLLC

(57) ABSTRACT

A model selection method for a hydraulic support includes: determining a surrounding rock-support mutual feedback equilibrium curve under a first equivalent in-situ stress and a surrounding rock-support mutual feedback equilibrium curve under a second equivalent in-situ stress, according to the first equivalent in-situ stress, the second equivalent in-situ stress, a stress of a fracture zone on a softening zone under the first equivalent in-situ stress, and a stress of the fracture zone on the softening zone under the second equivalent in-situ stress; determining a support strength of a to-be-selected hydraulic support on the surrounding rock and a minimum expansion and contraction quantity required by a movable column according to the equilibrium curves; determining the residual burst energy that needs to be absorbed by the hydraulic support; and determining the hydraulic support matched with roadway. The method quantitatively achieves parameterized model selection of the bursting-preventing hydraulic support of roadway.

15 Claims, 9 Drawing Sheets

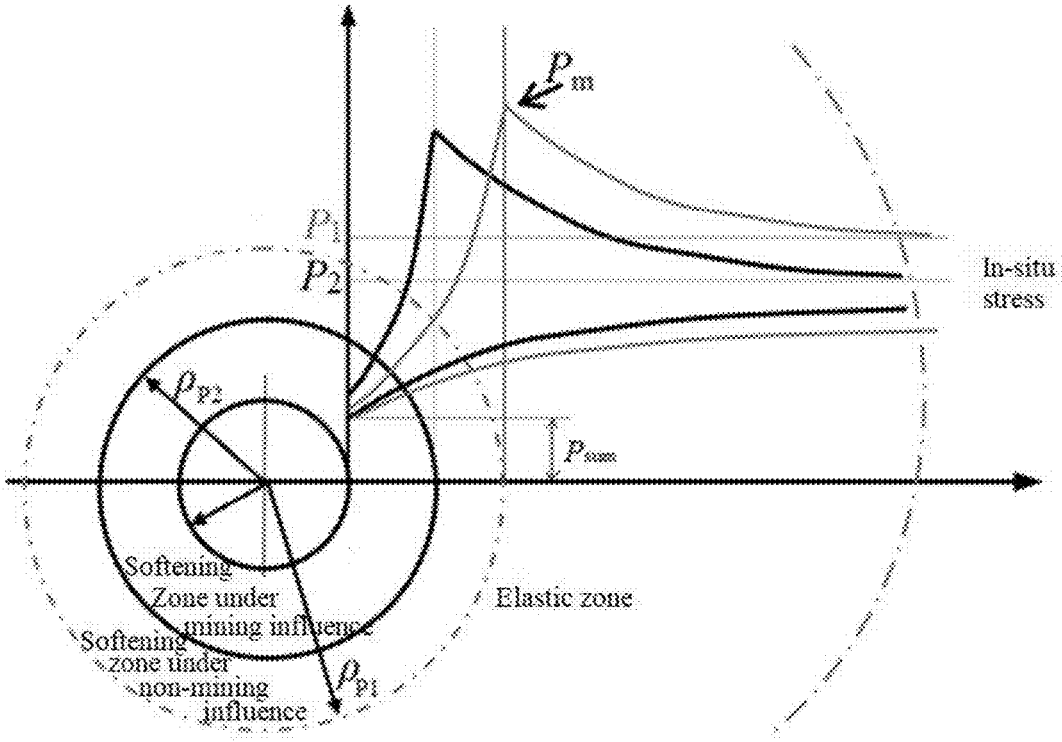

FIG. 4

S501 determining the first boundary stress corresponding to the first equivalent in-situ stress according to the system equation of the roadway

↓

S502 determining the first surrounding rock-support mutual feedback equilibrium curve, according to the first boundary stress, the function relation between the first boundary stress and both of the first support strength and the radius of the fracture zone, and the function relation between the displacement of the surrounding rock of the roadway and the radius of the crushing radius

FIG. 5

DETERMINING METHOD FOR BURSTING-PREVENTING PARAMETER OF ROADWAY SUPPORT FOR ROCK BURST IN COAL MINE, AND SYSTEM THEREOF

CROSS REFERENCE TO RELATED APPLICATIONS

This application claims priority to Chinese Application No. 202211311397.7, filed on Oct. 25, 2022, entitled "DETERMINING METHOD FOR BURSTING-PREVENTING PARAMETER OF ROADWAY SUPPORT FOR ROCK BURST IN COAL MINE, AND SYSTEM THEREOF", which is specifically and entirely incorporated by reference.

FIELD OF THE INVENTION

The present invention relates to the technical field of roadway support, and in particular to a determining method for a bursting-preventing parameter of roadway support for rock burst in a coal mine, and a system thereof

BACKGROUND OF THE INVENTION

Rock burst is one of the serious dynamic disasters in coal mines, and is a world-class problem faced by both rock mechanics and mining. Throughout the whole physical process of a burst disaster, although rock burst is often completed in milliseconds to seconds, the process can still be divided into a gestation stage before a burst start point and a destruction stage after the burst start point. Since the dynamic disaster in a deep coal mine usually has the characteristics of high randomness of a mine earthquake-induced burst, a wide range of the burst disaster and high difficulty in predicting the burst start, the energy-absorbing bursting-preventing support technology which aims at the burst-stopping treatment after the burst start naturally becomes the last safety barrier for the prevention and control of coal mine rock burst.

However, the existing design method of energy-absorbing bursting-preventing support and the model selection method cannot realize the quantitative analysis on the destruction stage after the burst start, and cannot realize the accurate model selection on support equipment.

SUMMARY OF THE INVENTION

An objective of the present invention is to provide a determining method for a bursting-preventing parameter of roadway support for rock burst in a coal mine, and a system thereof. On one hand, the loading effect of the mining of the working face on the advanced roadway is considered, and a "surrounding rock and support" deformation coordinated response and mutual feedback equilibrium relation of the roadway in which rock burst occurs can be quantitatively determined; and on the other hand, the superposition process of "far-field release disturbance energy of the roadway" and "near-field release energy of the roadway" when rock burst occurs is also considered, and the residual burst energy that needs to be absorbed by the to-be-selected hydraulic support can be quantitatively determined. Therefore, the support strength of the to-be-selected hydraulic support on the surrounding rock and the residual burst energy can be accurately determined, thereby achieving parameterized model selection of the bursting-preventing hydraulic support of the roadway at least based on the support strength and the residual burst energy.

To achieve the above objective, a first aspect of the present invention provides a model selection method for a hydraulic support. The model selection method includes: determining a first equivalent in-situ stress of a mining influence area roadway and a second equivalent in-situ stress of a non-mining influence area roadway; determining a first surrounding rock-support mutual feedback equilibrium curve under the first equivalent in-situ stress and a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress, the first equivalent in-situ stress, a function relation between a first boundary stress of the fracture zone under the first equivalent in-situ stress on a softening zone and both of a first support strength required by a roadway space and the radius of the fracture zone, and a function relation between a second boundary stress of the fracture zone under the second equivalent in-situ stress on the softening zone and both of a second support strength required by the roadway space and the radius of the fracture zone; determining a support strength of a to-be-selected hydraulic support on the surrounding rock and a minimum expansion and contraction quantity required by a movable column in an upright column of the hydraulic support, according to the first surrounding rock-support mutual feedback equilibrium curve, the second surrounding rock-support mutual feedback equilibrium curve, and a stress of an anchoring support of the roadway; determining residual burst energy that needs to be absorbed by the hydraulic support, according to a damage variable of coal rock in the softening zone and a damage variable of coal rock in the fracture zone of the surrounding rock, the radius of the fracture zone, a radius of the softening zone, a magnitude of a most dangerous seismicity, a distance from a source of the most dangerous seismicity to a destruction point of the roadway, an equivalent radius of the roadway space, and energy consumption of the anchoring support; and determining the hydraulic support matched with the roadway, according to the support strength of the hydraulic support on the surrounding rock, the residual burst energy that needs to be absorbed by the hydraulic support and the minimum expansion and contraction quantity required by the movable column in the upright column.

Optionally, wherein the determining a first surrounding rock-support mutual feedback equilibrium curve under the first equivalent in-situ stress and a second surrounding rock-support mutual feedback equilibrium curve under the second equivalent in-situ stress comprises: determining the first boundary stress corresponding to the first equivalent in-situ stress and the second boundary stress corresponding to the second equivalent in-situ stress according to the system equation of the roadway; determining the first surrounding rock-support mutual feedback equilibrium curve, according to the first boundary stress, the function relation between the first boundary stress and both of the first support strength and the radius of the fracture zone, and the function relation between the displacement of the surrounding rock of the roadway and the radius of the fracture zone; and determining the second surrounding rock-support mutual feedback equilibrium curve, according to the second boundary stress, the function relation between the second boundary stress and both of the second support strength and the radius of the fracture zone, and the function relation between the displacement of the surrounding rock of the roadway and the radius of the fracture zone.

Optionally, wherein the determining a support strength of a to-be-selected hydraulic support on the surrounding rock and a minimum expansion and contraction quantity required by a movable column in an upright column of the hydraulic support comprises: determining a first support equilibrium point of the first surrounding rock-support mutual feedback equilibrium curve and a second support equilibrium point of the second surrounding rock-support mutual feedback equilibrium curve, according to the first surrounding rock-support mutual feedback equilibrium curve and the second surrounding rock-support mutual feedback equilibrium curve; determining the support strength of the hydraulic support on the surrounding rock, according to the second support equilibrium point and the stress of the anchoring support of the roadway; and determining the minimum expansion and contraction quantity required by the movable column in the upright column of the hydraulic support, according to the first support equilibrium point and the second support equilibrium point.

Optionally, wherein the determining a first support equilibrium point of the first surrounding rock-support mutual feedback equilibrium curve and a second support equilibrium point of the second surrounding rock-support mutual feedback equilibrium curve comprises: in the case of no extreme point in the first surrounding rock-support mutual feedback equilibrium curve, performing the following steps: determining the first support equilibrium point by using a surrounding rock separation layer control condition, according to the first surrounding rock-support mutual feedback equilibrium curve; and determining the second support equilibrium point, according to a y-coordinate of the first support equilibrium point and the second surrounding rock-support mutual feedback equilibrium curve, or in the case of an extreme point in the first surrounding rock-support mutual feedback equilibrium curve, performing the following steps: determining the extreme point of the first surrounding rock-support mutual feedback equilibrium curve as the first support equilibrium point; and determining the second support equilibrium point, according to the y-coordinate of the first support equilibrium point and the second surrounding rock-support mutual feedback equilibrium curve, wherein the y-coordinate of the first support equilibrium point is equal to a y-coordinate of the second support equilibrium point.

Optionally, wherein the surrounding rock separation layer control condition comprises: the displacement of the surrounding rock of the roadway is less than or equal to a preset ratio of the equivalent radius of the roadway space.

Optionally, wherein the determining residual burst energy that needs to be absorbed by the hydraulic support comprises: determining total energy consumption of a resistance zone of the surrounding rock, according to the damage variable of the coal rock in the softening zone, the damage variable of the coal rock in the fracture zone, the equivalent radius of the roadway space, the radius of the fracture zone and the radius of the softening zone, wherein the resistance zone comprises the fracture zone and the softening zone; determining kinetic energy generated by burst of the resistance zone, according to the magnitude of the most dangerous seismicity, the distance from the source of the most dangerous seismicity to the destruction point of the roadway, the radius of the softening zone, the equivalent radius of the roadway space and an average density of the coal rock in the resistance zone; and determining the residual burst energy, according to the kinetic energy generated by the burst of the resistance zone, the total energy consumption of the resistance zone and the energy consumption of the anchoring support.

Optionally, wherein in the case of no extreme point in the second surrounding rock-support mutual feedback equilibrium curve, the determining the residual burst energy comprises: subtracting a sum of the total energy consumption of the resistance zone and the energy consumption of the anchoring support from the kinetic energy generated by the burst of the resistance zone to obtain the residual burst energy.

Optionally, wherein in the case of an extreme point in the second surrounding rock-support mutual feedback equilibrium curve, the determining the residual burst energy comprises: determining released energy of an elastic zone of the surrounding rock, according to the first equivalent in-situ stress, the y-coordinate of the second support equilibrium point and an energy release rate of the elastic zone; and subtracting the sum of the total energy consumption of the resistance zone and the energy consumption of the anchoring support from a sum of the released energy of the elastic zone and the kinetic energy generated by the burst of the resistance zone to obtain the residual burst energy.

Optionally, wherein the determining kinetic energy generated by burst of the resistance zone comprises: determining a burst motion speed of the coal rock in the resistance zone when rock burst occurs, according to the magnitude of the most dangerous seismicity, the distance from the source of the most dangerous seismicity to the destruction point of the roadway, the radius of the softening zone and the equivalent radius of the roadway space; determining a mass of the coal rock in the resistance zone, according to the radius of the softening zone, the equivalent radius of the roadway space and the average density of the coal rock in the resistance zone; and determining the kinetic energy generated by the burst of the resistance zone, according to the burst motion speed and the mass of the coal rock in the resistance zone.

Optionally, wherein the determining a first equivalent in-situ stress of a mining influence area roadway and a second equivalent in-situ stress of a non-mining influence area roadway comprises:

determining a mining-induced stress peak value $P_m$ in the surrounding rock of the non-mining influence area roadway, according to an in-situ stress $P_0$, a uniaxial compressive strength $\sigma_c$ of the coal rock and the following formula;

$$P_m = 1.5P_0 + \frac{\sigma_c}{4};$$

determining the second equivalent in-situ stress $P_2$, according to the mining-induced stress peak value $P_m$, a pressure relief efficiency coefficient $W_{drill}$ of the surrounding rock, the uniaxial compressive strength $\sigma_c$ of the coal rock and the following formula, $$P_m W_{drill} = 1.5P_2 + \frac{\sigma_c}{4};$$

and determining the first equivalent in-situ stress $P_1$ according to the mining-induced stress peak value $P_m$, the pressure relief efficiency coefficient $W_{drill}$ of the surrounding rock of the roadway, a mining-induced stress concentration coefficient $\lambda_m$ of the mining influence area roadway, the uniaxial compressive strength $\sigma_c$ of the coal rock and the following formula, $$\lambda_m P_m W_{drill} = 1.5P_1 + \frac{\sigma_c}{4}.$$

Optionally, further comprising: determining the radius of the fracture zone and the radius of the softening zone, according to the system equation of the roadway, the first equivalent in-situ stress, a disturbance response instability criterion, the damage variable of the coal rock in the elastic zone of the surrounding rock, the damage variable of the coal rock in the softening zone and the damage variable of the coal rock in the fracture zone.

Optionally, wherein the determining the hydraulic support matched with the roadway comprises: determining a static working load and an energy-absorbing receding resistance required by burst prevention of the hydraulic support, according to the support strength of the hydraulic support on the surrounding rock; determining an energy-absorbing receding stroke required by an energy absorber of the hydraulic support and energy that needs to be absorbed by a single support of the hydraulic support, according to the residual burst energy that needs to be absorbed by the hydraulic support; and selecting a model of the hydraulic support, according to the static working load and the energy-absorbing receding resistance required by burst prevention of the hydraulic support, the energy-absorbing receding stroke required by the energy absorber, the energy that needs to be absorbed by the single support and the minimum expansion and retraction quantity required by the movable column in the upright column.

Optionally, further comprising: determining an extension quantity of the movable column in the upright column, according to a selected hydraulic support and a height of the roadway; determining a rigidity of the selected hydraulic support according to the extension quantity of the movable column in the upright column; and determining an initial supporting opportunity, according to an initial support force, a working resistance and the rigidity of the selected hydraulic support and the second support equilibrium point.

In conclusion, according to the present invention, a first surrounding rock-support mutual feedback equilibrium curve under the first equivalent in-situ stress and a second surrounding rock-support mutual feedback equilibrium curve under the second equivalent in-situ stress are creatively determined; a support strength of a to-be-selected hydraulic support on the surrounding rock and a minimum expansion and contraction quantity required by a movable column in an upright column of the hydraulic support are determined, according to the first surrounding rock-support mutual feedback equilibrium curve, the second surrounding rock-support mutual feedback equilibrium curve, and a stress of an anchoring support of the roadway; the residual burst energy that needs to be absorbed by the hydraulic support is determined, according to a damage variable of coal rock in the softening zone and a damage variable of coal rock in the fracture zone of the surrounding rock, a radius of the fracture zone, a radius of the softening zone, the magnitude of the most dangerous seismicity, a distance from the source of the most dangerous seismicity to a destruction point of the roadway, an equivalent radius of the roadway space, and energy consumption of the anchoring support; and the hydraulic support matched with the roadway is determined, according to the support strength of the hydraulic support on the surrounding rock, the residual burst energy that needs to be absorbed by the hydraulic support and the minimum expansion and contraction quantity required by the movable column in the upright column. Therefore, according to the present invention, on one hand, the loading effect of the mining of the working face on the advanced roadway is considered, and a "surrounding rock and support" deformation coordinated response and mutual feedback equilibrium relation of the roadway in which rock burst occurs can be quantitatively determined; and on the other hand, the superposition process of "far-field release disturbance energy of the roadway" and "near-field release energy of the roadway" when rock burst occurs is also considered, and the residual burst energy that needs to be absorbed by the to-be-selected hydraulic support can be quantitatively determined. Therefore, the support strength of the to-be-selected hydraulic support on the surrounding rock and the residual burst energy can be accurately determined, thereby achieving parameterized model selection of the bursting-preventing hydraulic support of the roadway at least based on the support strength and the residual burst energy.

A second aspect of the present invention provides a model selection system for a hydraulic support. The model selection system includes: a stress determining device, configured to determine a first equivalent in-situ stress of a mining influence area roadway and a second equivalent in-situ stress of a non-mining influence area roadway; an equilibrium curve determining device, configured to determine a first surrounding rock-support mutual feedback equilibrium curve under the first equivalent in-situ stress and a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress, the first equivalent in-situ stress, a function relation between a first boundary stress of the fracture zone under the first equivalent in-situ stress on a softening zone and both of a first support strength required by a roadway space and the radius of the fracture zone, and a function relation between a second boundary stress of the fracture zone under the second equivalent in-situ stress on the softening zone and both of a second support strength required by the roadway space and the radius of the fracture zone; an expansion and contraction quantity determining device, configured to determine a support strength of a to-be-selected hydraulic support on the surrounding rock and a minimum expansion and contraction quantity required by a movable column in an upright column of the hydraulic support, according to the first surrounding rock-support mutual feedback equilibrium curve, the second surrounding rock-support mutual feedback equilibrium curve, and a stress of an anchoring support of the roadway; a residual burst energy determining device, configured to determine residual burst energy that needs to be absorbed by the hydraulic support, according to a damage variable of coal rock in the softening zone and a damage variable of coal rock in the fracture zone of the surrounding rock, a radius of the fracture zone, a radius of the softening zone, a magnitude of a most dangerous seismicity, a distance from a source of the most dangerous seismicity to a destruction point of the roadway, an equivalent radius of the roadway space, and energy consumption of the anchoring support; and a hydraulic support determining device, configured to determine the hydraulic support matched with the roadway, according to the support strength of the hydraulic support on the surrounding rock, the residual burst energy that needs to be absorbed by the hydraulic support and the minimum expansion and contraction quantity required by the movable column in the upright column.

Compared with the prior art, the model selection system for the hydraulic support and the model selection method for the hydraulic support have the same advantages, which will not be elaborated herein.

A third aspect of the present invention provides a computer-readable storage medium. The computer-readable storage medium stores a computer program; and when the computer program is executed by a processor, the above model selection method for a hydraulic support is implemented.

Other features and advantages of the embodiments of the present invention will be described in detail in the following specific implementation part.

BRIEF DESCRIPTION OF DRAWINGS

The accompanying drawings are intended to provide further understanding of the embodiment of the present invention, constitute a part of the specification, and together with the following specific embodiments, are used to explain the embodiments of the present invention, but do not constitute a limitation to the embodiments of the present invention. In the drawings:

FIG. 4 is a schematic diagram of a mining-induced stress peak value in surrounding rock and the distribution of an in-situ stress;

FIG. 5 is a flowchart of determining a first surrounding rock-support mutual feedback equilibrium curve under the first equivalent in-situ stress according to an embodiment of the present invention;

DETAILED DESCRIPTION OF THE EMBODIMENTS

The specific embodiments of the present invention are described below in detail with reference to the accompanying drawings. It should be understood that the specific embodiments described herein are only used to illustrate and interpret the present invention and are not intended to restrict the present invention.

The general idea of the present invention is: establishing a mechanical analysis model for roadway rock burst, and deducing and drawing a roadway "surrounding rock-support" mutual feedback equilibrium equation and characteristic curve under the action of an in-situ stress; accordingly, determining whether an extreme point of dynamic instability is present in the roadway, and if the extreme point is present, further determining parameters such as a critical support stress and a critical surrounding rock displacement corresponding thereto, and a critical softening radius of the surrounding rock; calculating and determining the maximum release energy after the roadway rock burst occurs; and guiding the model selection of the bursting-preventing hydraulic support respectively according to a design principle of a bursting-preventing support strength and an energy conservation principle.

Figure 1:
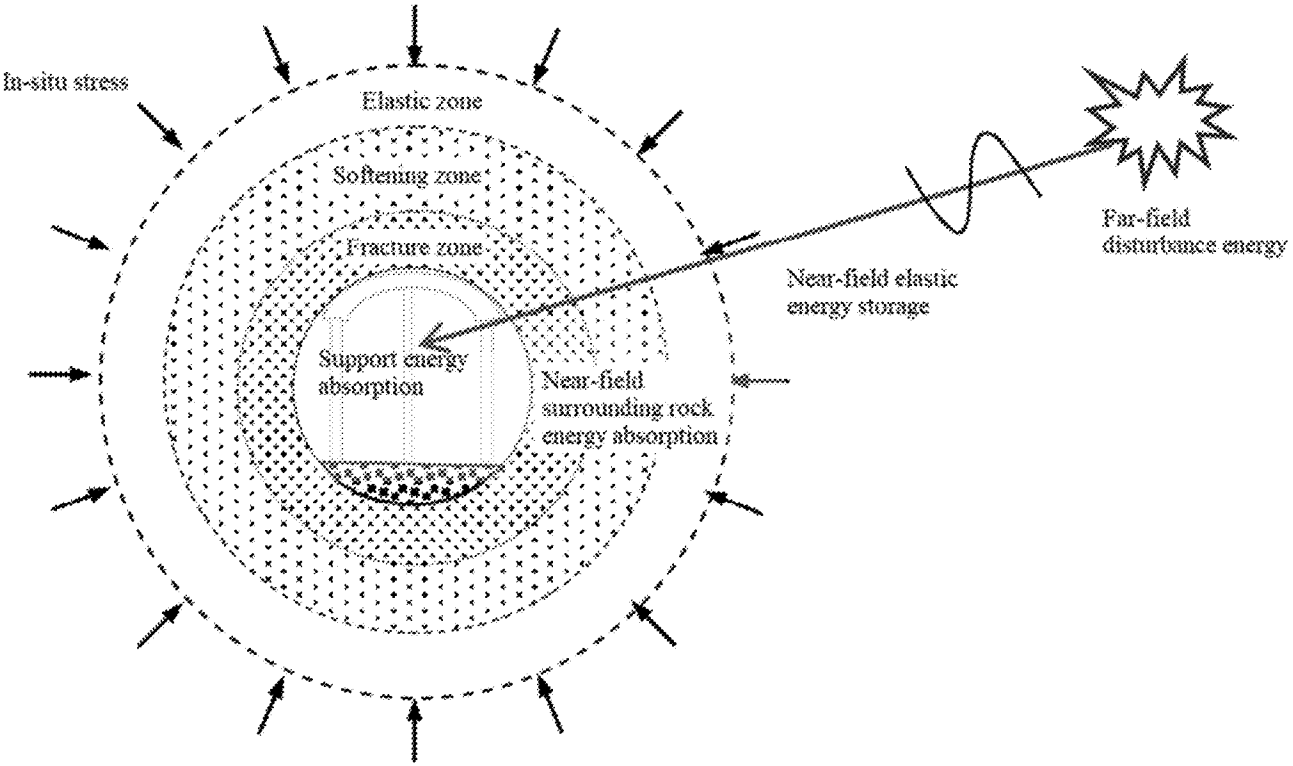
FIG. 1 is a schematic diagram of the transfer process of rock burst energy of the roadway under the disturbance of a large-energy mine earthquake.

The roadway includes surrounding rock and a roadway space formed by the surrounding rock (the equivalent radius is $\rho_0$), as shown in FIG. 1. The surrounding rock of the roadway includes an elastic zone, a softening zone (the radius is $\rho_p$) and a fracture zone (the radius is $\rho_d$), as shown in FIG. 1. Based on the disturbance response instability theory of the rock burst, for the given coal and rock mass deformation system (roadway), the radius of a plastic softening zone (hereinafter referred to as a softening zone) generated under the action of a second equivalent in-situ stress $P_2$ (or a first equivalent in-situ stress $P_1$) is $\rho_{P2}$ (or $\rho_{P1}$), as shown in FIG. 4.

The following will perform description by taking two embodiments as examples, but not limited to the following two embodiments. Firstly, the basic information of the two embodiments is described; then, the process of determining the support strength, the residual burst energy and the model selection of a hydraulic support in the two embodiments is described in detail through comparison.

Embodiment 1

The roadway near-field surrounding rock has no dynamic instability point under the mining action ($P_1$=24.76 MPa) of a working face (i.e., burst disaster energy is only the energy of a far-field disturbance earthquake source point).

A certain mine coal seam is a near horizontal coal seam. The working face advanced roadway to be subjected to bursting-preventing support design has a rectangular cross-section, a height of 3.2 m and a cross-section width (that is, the roadway width) of 4.4 m, the equivalent circular radius (that is, the equivalent radius of the roadway space) of the circumcircle of the rectangular roadway is 2.7 m (which may be determined below), the number of a row of anchor cables is 5, and the number of a row of anchor bolts is 9. The active support of the roadway is an anchor net cable support for enhancing the bursting-preventing ability of the roadway.

The equivalent radius $\rho_0$ (for example, the circumcircle radius of the rectangular roadway, $\rho_0$=2.70 m) of the roadway space may be determined according to the main rock mechanical parameters of the surrounding rock of the roadway; and the rock mechanical parameters may include a uniaxial compressive strength $\sigma_c$=11.60 MPa, an elasticity modulus E=2780 MPa, a burst tendency index $K=\mu_1/E=1.10$ of the coal rock, a residual falling modulus $\lambda_2$=14 MPa, a residual strength coefficient $\xi$=0.22 and a Poisson ratio as $\upsilon$=0.25, wherein $\lambda_1$ is a coal rock softening falling modulus (MPa). The main parameters of the roadway and the surrounding rock thereof may be shown in Table 1.

TABLE 1

Main physical and mechanical parameters of roadway and surrounding rock thereof

| Serial Number | Name of Main Control Parameter | Symbol | Unit | A Certain Mine in Shandong |
|---|---|---|---|---|
| 1 | burst tendency index of coal rock | K | — | 1.10 |
| 2 | Uniaxial compressive strength of coal rock | $\sigma_c$ | /MPa | 11.60 |
| 3 | Elasticity modulus of coal rock | E | Gpa | 2.78 |
| 4 | Internal friction angle | Φ | ° | 30 |
| 5 | Residual falling modulus | $\lambda_2$ | MPa | 14 |
| 6 | Residual strength coefficient | ξ | — | 0.22 |
| 7 | Poisson ratio | υ | — | 0.25 |
| 8 | Height of roadway space | H | m | 3.2 |
| 9 | Width of roadway space | B | m | 4.4 |
| 10 | Equivalent radius of roadway space | $\rho_0$ | m | 2.70 |
| 11 | In-situ stress | $P_0$ | MPa | 14.00 |
| 12 | Mining-induced stress concentration coefficient of roadway in mining influence area | $\lambda_m$ | — | 1.3138 |
| 13 | Pressure relief efficiency coefficient of surrounding rock | $W_{drill}$ | — | 1 |
| 14 | Equivalent in-situ stress of roadway in non-mining influence area | $P_2$ | MPa | 14 |
| 15 | Equivalent in-situ stress of roadway in mining influence area | $P_1$ | MPa | 24.76 |

Embodiment 2

A dynamic instability point appears in the roadway near-field surrounding rock under the action of a mining-induced stress ($P_1$=47.62 MPa) during mining of a working face (i.e., the burst disaster energy in the surrounding rock of the roadway includes far-field disturbance earthquake source energy and near-field surrounding rock dynamic instability energy).

The cross section of a certain mine 513 working face roadway is surround, the span of the coal seam mining roadway space (that is, the width of the roadway space) is 5.2 m, and the height is 3.8 m.

(1) The Original Support Form of the 513 Outer Segment Working Face

The support form of two gateways of the 513 outer segment working face is anchor net (cable) and shed-building combined support; three sections of U-shaped steel sheds are adopted, each U-shaped steel shed is lapped at two places, and four pairs of clips are used at each lapped place; a bottom arc is added for sealing the bottom, each U-shaped steel bottom arc is lapped at four places, and four pairs of clips are used at each lapped place; the distance between half coal rock sheds of the coal road is 500 mm; the specification of anchor bolts on two sides is: Φ22×2400 mm, the row distance is 800×1000 mm, and the number of the anchor bolts is 8; and the specification of anchor cables on the top plate is: Φ21.6×8200 mm, the row distance is 800×1000 mm, and the number of the anchor cables is 6.

(2) Constant-Resistance Anchor Cable Reinforced Support of Two Gateways of the 513 Outer Segment Working Face Before mining, an anchor cable with high pre-tightening force, constant resistance and large deformation is used to reinforce the advanced 300 m range of the transporting and return air gateways of the 513 outer segment working face, and a grouting anchor cable is combined to improve the overall self-bearing capacity of the surrounding rock, so that the surrounding rock can adapt to the large deformation of the roadway and the bursting-preventing property can be improved; and in the mining process, forward movement is continued, and the reinforced support distance is ensured not less than 300 m, wherein the construction of the transporting gateway starts from the open-off cut and stops at a position where the intersection of the transporting gateway and a material road extends outwards by 20 m, and the construction of the return air gateway starts from the open-off cut and stops at a position where the intersection of the return air gateway and a material road extends outwards by 20 m. Meanwhile, in the mining process, the advanced 200 m of the two gateways are reinforced and supported by an energy-absorbing bursting-preventing support.

The equivalent radius $\rho_0$=2.59 m of the roadway space may be determined according to the main rock mechanical parameters of the surrounding rock of the mining roadway of the 513 working face; and the rock physical and mechanical parameters may include a uniaxial compressive strength $\sigma_c$=12.82 MPa, an elasticity modulus E=2940 MPa, a burst tendency index K=1.86 of the coal rock, a residual falling modulus $\mu_2$=15, a residual strength coefficient ξ=0.24 and a Poisson ratio υ=0.25. Assuming that the pressure relief of the surrounding rock of the roadway only changes the distribution of the mining-induced stress, the coupling effect among multiple bursting-preventing processes can be ignored, and the main parameters of the 513 working face roadway to be subjected to bursting-preventing support design and the surrounding rock thereof are shown in Table 2.

TABLE 2

Main parameters of mining roadway and surrounding rock thereof of a certain mine 513 working face

| Serial Number | Name of Main Control Parameter | Symbol | Unit | Parameter Statistics |
|---|---|---|---|---|
| 1 | Burst energy index of coal rock | K | — | 1.86 |
| 2 | Uniaxial compressive strength of coal rock | $\sigma_c$ | MPa | 12.82 |
| 3 | Elasticity modulus of coal rock | E | Mpa | 2940 |
| 4 | Internal friction angle | Φ | ° | 30 |
| 5 | Residual falling modulus | $\lambda_2$ | MPa | 15 |
| 6 | Residual strength coefficient | ξ | — | 0.24 |
| 7 | Poisson ratio | υ | — | 0.25 |
| 8 | Roadway radius | $\rho_0$ | m | 2.59 |
| 9 | In-situ stress | $P_0$ | MPa | 42.27 |
| 10 | Mining-induced stress concentration coefficient of roadway in mining influence area | $\lambda_m$ | — | 1.85 |
| 11 | Pressure relief efficiency coefficient of surrounding rock | $W_{drill}$ | | 0.6057 |
| 12 | Equivalent in-situ stress of roadway in non-mining influence area | $P_2$ | MPa | 24.76 |
| 13 | Equivalent in-situ stress of roadway in mining influence area | $P_1$ | MPa | 47.62 |

Figure 2:
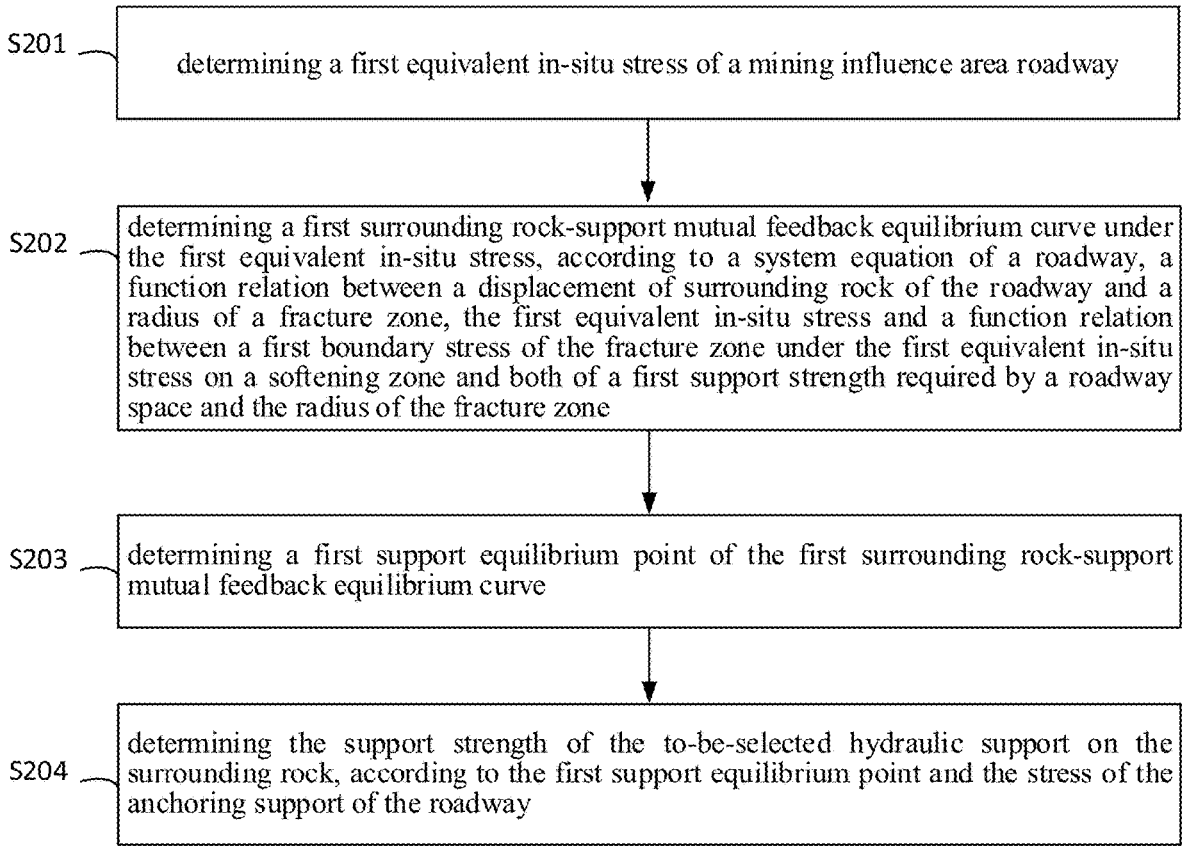
FIG. 2 is a flowchart of a determining method for a support strength according to an embodiment of the present invention.

FIG. 2 is a flowchart of a determining method for a support strength according to an embodiment of the present invention. As shown in FIG. 2, the determining method may include the following steps S201-S204.

Step S201: determining a first equivalent in-situ stress of a mining influence area roadway.

Figure 6:
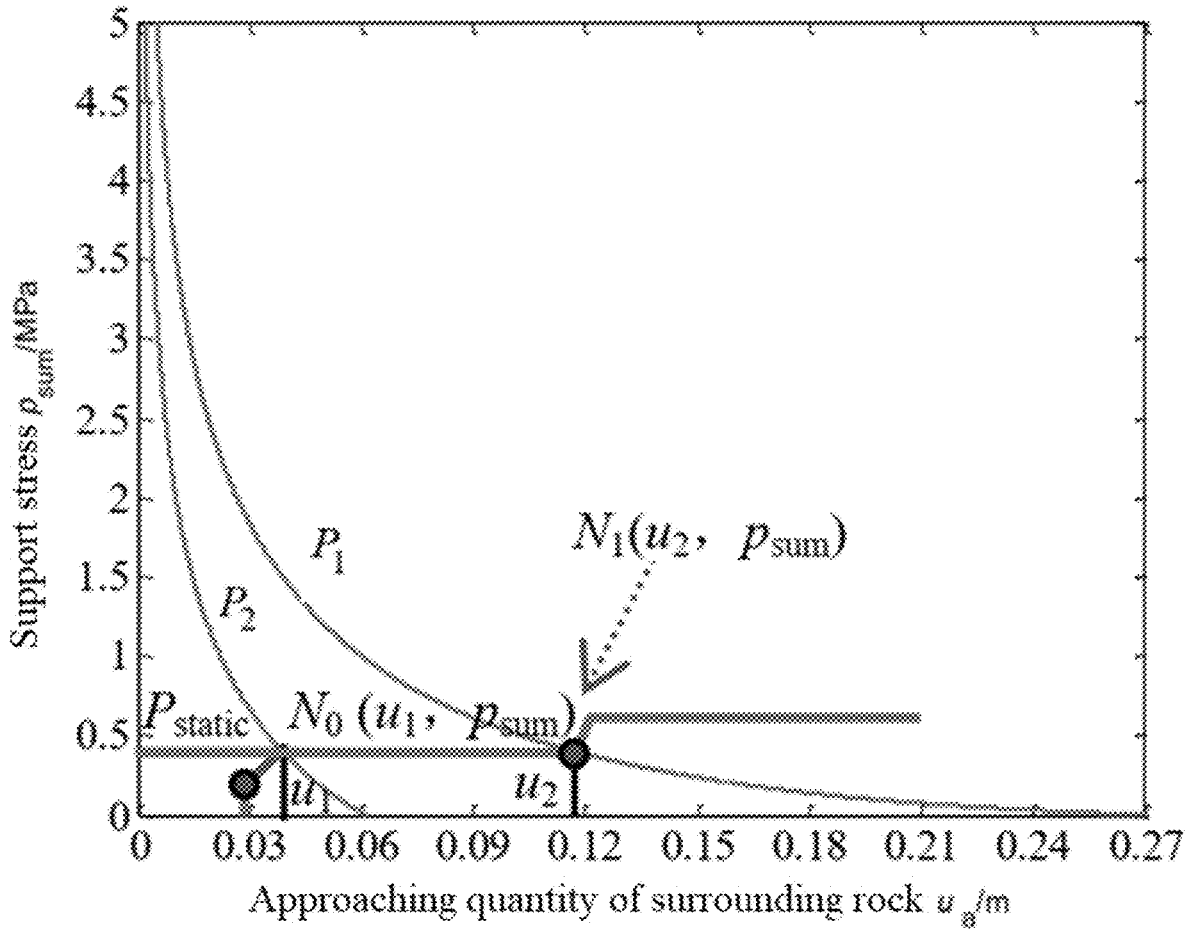
FIG. 6 is a "surrounding rock-support" mutual feedback equilibrium characteristic I-type curve of the roadway according to an embodiment of the present invention.
Figure 7:
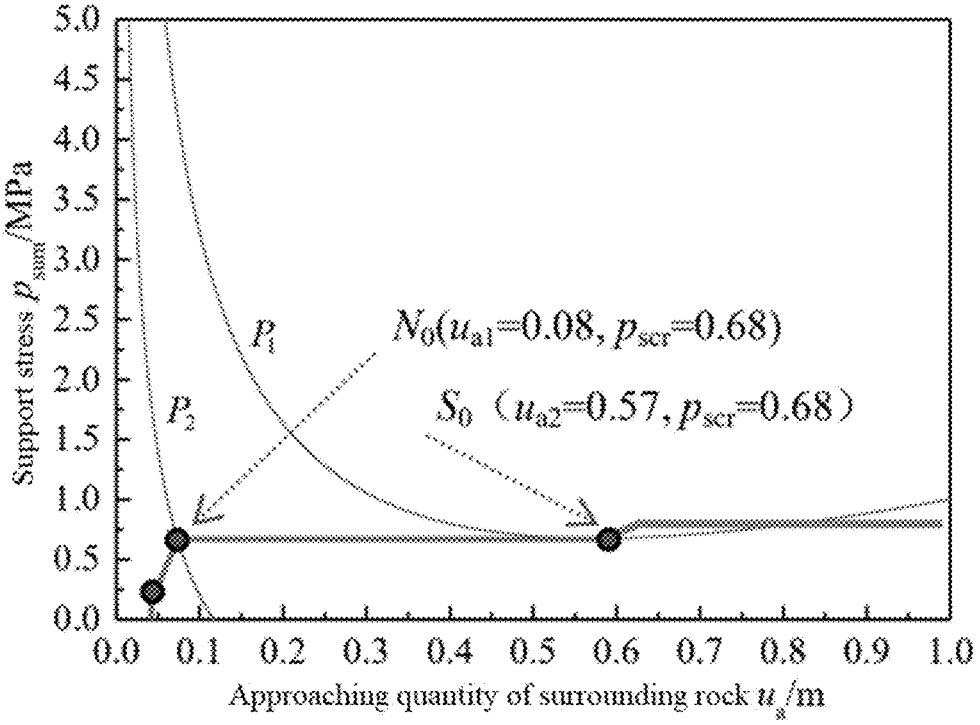
FIG. 7 is an advanced roadway "surrounding rock-support" mutual feedback equilibrium characteristic II-type curve according to an embodiment of the present invention.

The non-mining influence area roadway refers to a roadway under the non-mining influence, the mining influence area roadway refers to a roadway under the mining influence, and the non-mining influence area roadway and the mining influence area roadway refer to the same roadway. The first equivalent in-situ stress $P_1$ (Embodiment 1: as shown in FIG. 4 or FIG. 6, $P_1$=24.76 MPa; and Embodiment 2: as shown in FIG. 7, $P_1$=47.62 MPa) may be determined through any existing method.

At the same time, the determining method further includes: determining a second equivalent in-situ stress of the non-mining influence area roadway.

Specifically, the step of determining the first equivalent in-situ stress of the mining influence area roadway and the second equivalent in-situ stress of the non-mining influence area roadway may include the following three steps.

Firstly, a mining-induced stress peak value $P_m$ of the surrounding rock in the non-mining influence area roadway is determined according to an in-situ stress $P_0$, a uniaxial compressive strength $\sigma_c$ of the coal rock and the following formula (1-1):

$$P_m = 1.5P_0 + \frac{\sigma_c}{4} \tag{1-1}$$

Then, the second equivalent in-situ stress $P_2$ (that is, the equivalent in-situ stress of the non-mining influence area roadway) is determined according to the mining-induced stress peak value $P_m$, a pressure relief efficiency coefficient $W_{drill}$ of the surrounding rock, the uniaxial compressive strength $\sigma_c$ of the coal rock and the following formula (1-2):

$$P_m W_{drill} = 1.5P_2 + \frac{\sigma_c}{4} \tag{1-2}$$

Finally, the first equivalent in-situ stress (that is, the equivalent in-situ stress $P_1$ of the mining influence area roadway) is determined according to the mining-induced stress peak value $P_m$, the pressure relief efficiency coefficient $W_{drill}$ of the surrounding rock, a mining-induced stress concentration coefficient $\lambda_m$ of the mining influence area roadway, the uniaxial compressive strength $\sigma_c$ of the coal rock and the following formula (1-3):

$$\lambda_m P_m W_{drill} = 1.5P_1 + \frac{\sigma_c}{4} \tag{1-3}$$

Of course, the steps of determining the first equivalent in-situ stress and the second equivalent in-situ stress have no sequence.

Figure 3:
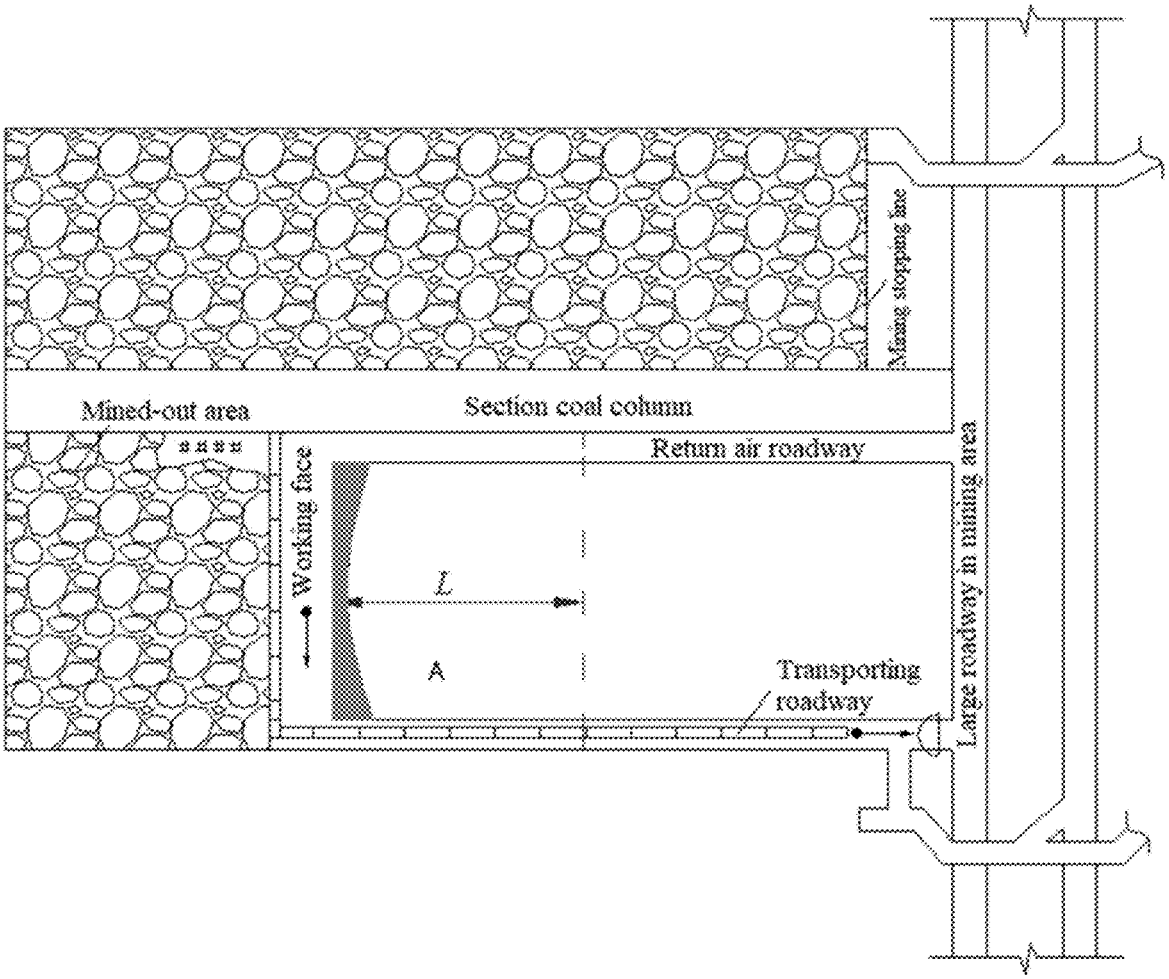
FIG. 3 is a schematic diagram of a working face and an advanced stress concentration area thereof.

For Embodiment 1: firstly, the mining-induced peak value $P_m$ (as shown in FIG. 4 or FIG. 6, $P_m$=23.9 MPa) of the surrounding rock of the non-mining influence area roadway may be determined through $P_0$=14 MPa, $\sigma_c$=11.60 MPa (as shown in Table 1) and the above formula (1-1). Then, the equivalent in-situ stress $P_2$ (as shown in FIG. 4 or FIG. 6, $P_2$=$P_0$=14 MPa) is determined by combining $P_m$=23.9 MPa, $W_{drill}$=1 and $\sigma_c$=11.60 MPa (as shown in Table 1) and using the above formula (1-2). Finally, the equivalent in-situ stress $P_1$ (as shown in FIG. 4 or FIG. 6, $P_1$=24.76 MPa) of the mining influence area roadway (the roadway A shown in FIG. 3) is determined by combining $P_m$=23.9 MPa, $W_{drill}$=1, $\lambda_m$=1.3138, $\sigma_c$=11.60 MPa and the above formula (1-3).

For Embodiment 2: firstly, the mining-induced peak value $P_m$ (as shown in FIG. 4 or FIG. 6, $P_m$=66.61 MPa) of the surrounding rock of the non-mining influence area roadway may be determined through $P_0$=42.27 MPa, $\sigma_c$=12.82 MPa (as shown in Table 1) and the above formula (1-1). Then, the equivalent in-situ stress $P_2$ (as shown in FIG. 4 or FIG. 6, $P_2$=24.76 MPa) is determined by combining $P_m$=66.61 MPa, $W_{drill}$=0.6057 and $\sigma_c$=12.82 MPa (as shown in Table 1) and using the above formula (1-2). Finally, the equivalent in-situ stress $P_1$ (as shown in FIG. 7, $P_1$=47.62 MPa) of the mining influence area roadway (the roadway A shown in FIG. 3) is determined by combining $P_m$=66.61 MPa, $W_{drill}$=0.6057, $\lambda_m$=1.85, $\sigma_c$=12.82 MPa and the above formula (1-3).

Step S202: determining a first surrounding rock-support mutual feedback equilibrium curve under the first equivalent in-situ stress, according to a system equation of a roadway, a function relation between a displacement of surrounding rock of the roadway and a radius of a fracture zone, the first equivalent in-situ stress and a function relation between a first boundary stress of the fracture zone under the first equivalent in-situ stress on a softening zone and both of a first support strength required by a roadway space and the radius of the fracture zone.

The step S202 of determining the first surrounding rock-support mutual feedback equilibrium curve under the first equivalent in-situ stress may include the following steps S501-S502, as shown in FIG. 5.

Step S501: determining the first boundary stress corresponding to the first equivalent in-situ stress according to the system equation of the roadway.

The system equation of the roadway is as follows:

$$\frac{P}{\sigma_c} = \frac{m+1}{2}\left[\frac{p_{d-p}}{\sigma_c} + \frac{1+\lambda_1/E}{m-1} - \frac{\lambda_1/E}{m+1}\left(\frac{\rho_p}{\rho_d}\right)^2\right]\left(\frac{\rho_p}{\rho_d}\right)^{m-1} - \frac{1+\lambda_1/E}{m-1} \tag{2}$$

wherein m is an intermediate variable, $$m = \frac{1+\sin\phi}{1-\sin\phi},$$

and $\phi$ is an internal friction angle of the surrounding rock; $p_{d-p}$ is a boundary stress (MPa) (which may be equal to the first boundary stress) of the fracture zone on the softening zone; P is an in-situ stress (which may be equal to the first equivalent in-situ stress $P_1$) (MPa) of the roadway; and $$\frac{\rho_p}{p_d} = k,$$

$\rho_d$ is the radius (m) of the fracture zone, $\rho_p$ is the radius (m) of the softening zone, and k is a constant. The above formula (2) indicates that the boundary stress of the fracture zone on the softening zone changes with the change of the in-situ stress. Specifically, the first equivalent in-situ stress $P_1$ may be substituted into the formula (2) to determine the corresponding first boundary stress.

Step S502: determining the first surrounding rock-support mutual feedback equilibrium curve, according to the first boundary stress, the function relation between the first boundary stress and both of the first support strength and the radius of the fracture zone, and the function relation between the displacement of the surrounding rock of the roadway and the radius of the fracture zone.

The function relation between the displacement of the surrounding rock of the roadway and the radius of the fracture zone is:

$$u_a = \frac{\sqrt{3}}{2}\sigma_c\left[\frac{1}{E} + \frac{1-\xi}{\lambda_1}\right]\frac{\rho_d^2}{\rho_0} \tag{3}$$

wherein $u_a$ is the displacement (m) of the surrounding rock of the roadway; $\sigma_c$ is the uniaxial compressive strength; $\rho_d$ is the radius (m) of the fracture zone of the surrounding rock; $\rho_0$ is the equivalent radius (m) of the roadway space; $\lambda_1$ is the softening falling modulus (MPa) of the coal rock; E is the elasticity modulus (Gpa); and $\xi$ is the residual strength coefficient.

Firstly, the function relation between the first boundary stress and both of the first support strength $p_{sum}$ required by the roadway space and the radius $\rho_d$ of the fracture zone is determined as shown in the following formula (4):

$$p_{d-p} = p_{sum}\left(\frac{\rho_0}{\rho_d}\right)^{1-q} + \left(\frac{\alpha}{1-q}\right)\left[1-\left(\frac{\rho_0}{\rho_d}\right)^{1-q}\right] + \left(\frac{\beta}{1+q}\right)\left[1-\left(\frac{\rho_d}{\rho_0}\right)^{q+1}\right] \tag{4}$$

wherein $$\alpha = \sigma_c\left[\frac{\lambda_2}{E} + \frac{\lambda_2}{\lambda_1}(1-\xi)+\xi\right],\ \beta = \sigma_c\left[\frac{\lambda_2}{E} + \frac{\lambda_2}{\lambda_1}(1-\xi)\right];$$

$\rho_0$ is the equivalent radius of the roadway space; $p_{sum}$ is the total support strength (MPa) of support equipment in the roadway; and q is an intermediate variable, $$q = \frac{1+\sin\varphi'}{1-\sin\varphi'},$$

and $\varphi'$ is the internal friction angle of the surrounding rock in the fracture zone. The above formula (4) indicates that the support strength required by the roadway space changes with the change of the boundary stress of the fracture zone on the softening zone.

Then, the function relation (not listed) (that is, the first surrounding rock-support mutual feedback equilibrium curve, the curve corresponding to $P_1$ shown in FIG. 6) between the first support strength $p_{sum}$ required by the roadway space with the equivalent radius $\rho_0$ and the displacement $u_a$ of the surrounding rock of the roadway may be obtained by combining the first boundary stress and the simultaneous formulas (3)-(4). The curve corresponding to $P_1$ indicates that under the combined action of the in-situ stress $P_1$ and the first support strength $p_{sum}$, the fracture zone with the radius being $\rho_d$ and the softening zone with the radius being $\rho_p$ are in an equilibrium state.

The second surrounding rock-support mutual feedback equilibrium curve under the second equivalent in-situ stress may also be determined while the step S202 is performed. The determining method may further include: determining a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress and a function relation between a second boundary stress of the fracture zone under the second equivalent in-situ stress on the softening zone and both of a second support strength required by the roadway space and the radius of the fracture zone.

The step of determining the second surrounding rock-support mutual feedback equilibrium curve under the second equivalent in-situ stress may include: determining the second boundary stress corresponding to the second equivalent in-situ stress according to the system equation of the roadway; and determining the second surrounding rock-support mutual feedback equilibrium curve, according to the second boundary stress, the function relation between the second boundary stress and both of the second support strength required by the space formed by the roadway and the radius of the fracture zone, and the function relation between the displacement of the surrounding rock of the roadway and the radius of the fracture zone.

Specifically, the second boundary stress corresponding to the second equivalent in-situ stress and shown in the formula (2) may be determined. P is the in-situ stress (which may be equal to the second equivalent in-situ stress $P_2$) (MPa) of the roadway. Then, the function relation between the second boundary stress and both the second support strength $p_{sum}$ required by the space formed by the roadway and the radius $\rho_d$ of the fracture zone is determined as shown in the formula (4). Finally, the function relation (not listed) (that is, the second surrounding rock-support mutual feedback equilibrium curve, the curve corresponding to $P_2$ shown in FIG. 6) between the second support strength $p_{sum}$ required by the roadway space with the equivalent radius $\rho_0$ and the displacement $u_a$ of the surrounding rock of the roadway may be obtained by combining the second boundary stress and the simultaneous formulas (3)-(4). The curve corresponding to $P_2$ indicates that under the combined action of the in-situ stress $P_2$ and the second support strength $p_{sum}$, the fracture zone with the radius being $\rho_d$ and the softening zone with the radius being $\rho_p$ are in an equilibrium state.

That is, with the simultaneous equations (2), (3) and (4), the "surrounding rock-support" mutual feedback equilibrium curve is drawn under the control of the second equivalent in-situ stress $P_2$ and the first equivalent in-situ stress $P_1$, and then it is determined whether an extreme point $S_0$ (as shown in the corresponding FIG. 7 in Embodiment 2) representing the burst instability of the surrounding rock of the roadway is present in the surrounding rock-support mutual feedback equilibrium curve under the control of the first equivalent in-situ stress $P_1$ through the step S203. If the extreme point $S_0$ of the dynamic instability is not present, it is called a I-type curve of the roadway "surrounding rock-support" mutual feedback equilibrium characteristic (as shown in the corresponding FIG. 6 in Embodiment 1), for example, the extreme point is not present in the working face roadway with the rectangular cross section in Embodiment 1, and the effect of the far-field disturbance earthquake source should be considered in the bursting-preventing support design; otherwise, it is called a II-type curve (as shown in the corresponding FIG. 7 in Embodiment 2), for example, the extreme point is present in the mining roadway of a certain mine 513 working face in Embodiment 2, both the burst influence of the near-field surrounding rock and the superposed effect of the far-field mine earthquake load and energy disturbance should be considered in the bursting-preventing support design.

Step S203: determining a first support equilibrium point of the first surrounding rock-support mutual feedback equilibrium curve.

The step S203 of determining a first support equilibrium point of the first surrounding rock-support mutual feedback equilibrium curve may include any one of the following two cases.

Case 1 (Embodiment 1): in the case of no extreme point in the first surrounding rock-support mutual feedback equilibrium curve, the first support equilibrium point is determined by using the surrounding rock separation layer control condition according to the first surrounding rock-support mutual feedback equilibrium curve.

The surrounding rock separation layer control condition may include: the displacement of the surrounding rock of the roadway is less than or equal to a preset ratio of the equivalent radius of the roadway space. Specifically, the preset ratio may be any one of 0-6% (or any one of 0-9%).

Case 2 (Embodiment 2): in the case of an extreme point in the first surrounding rock-support mutual feedback equilibrium curve, the extreme point of the first surrounding rock-support mutual feedback equilibrium curve is determined as the first support equilibrium point.

Then, a second support equilibrium point of the second surrounding rock-support mutual feedback equilibrium curve may be determined according to the first support equilibrium point.

The determining method may further include: determining a second support equilibrium point of the second surrounding rock-support mutual feedback equilibrium curve. Correspondingly, the step of determining a second support equilibrium point of the second surrounding rock-support mutual feedback equilibrium curve includes: determining the second support equilibrium point, according to the y-coordinate of the first support equilibrium point and the second surrounding rock-support mutual feedback equilibrium curve, wherein the y-coordinate of the first support equilibrium point is equal to the y-coordinate of the second support equilibrium point.

The specific process of how to determine the first support equilibrium point and the second support equilibrium point is described below respectively for the above two cases.

For Case 1 (Embodiment 1): if an extreme point $S_0$ representing the burst instability of the surrounding rock of the roadway is not present in the surrounding rock-support mutual feedback equilibrium curve under the control of the first equivalent in-situ stress $P_1$ (as shown in FIG. 6, the I-type curve, that is, the roadway does not have the possibility of dynamic instability under the condition of high static load), and the x-coordinate (the displacement of the surrounding rock) of a certain point $N_1$ on the first surrounding rock-support mutual feedback equilibrium curve meets the surrounding rock separation layer control condition (for example, the preset ratio is 4.18%), the point $N_1$ ($u_2$=0.1129 m, $p_{sum}$=0.43949 MPa) is determined as the first support equilibrium point. Then, the y-coordinate of the first support equilibrium point is equal to the y-coordinate of the second support equilibrium point, so a second support equilibrium point $N_0$ ($u_1$=0.03773 m, $p_{sum}$=0.43949 MPa) may be determined.

For Case 2 (Embodiment 2): if an extreme point $S_0$ representing the burst instability of the surrounding rock of the roadway is present in the surrounding rock-support mutual feedback equilibrium curve under the control of the first equivalent in-situ stress $P_1$ (as shown in FIG. 7, the II-type curve, that is, the roadway has the possibility of dynamic instability under the condition of high static load), the extreme point $S_0$ (0.57 m, 0.68 MPa) is determined as the first support equilibrium point. Then, the y-coordinate of the first support equilibrium point is equal to the y-coordinate of the second support equilibrium point, so the second support equilibrium point $N_0$ (0.08 m, 0.68 MPa) may be determined.

Step S204: determining the support strength of the to-be-selected hydraulic support on the surrounding rock, according to the first support equilibrium point and the stress of the anchoring support of the roadway.

The support strength $p_{s\text{-}static}$ may be determined according to the y-coordinate $p_{sum}$ of the first support equilibrium point, the stress $p_{bolt}$ of the anchoring support of the roadway and the following formula (5):

$$P_{s\text{-}static}=(p_{sum}-\omega_1 p_{bolt})/\omega_2 \quad (5)$$

wherein $\omega_1$ and $\omega_2$ are respectively the collaborative coefficients of the anchoring support and the support strength of the hydraulic support. Further, the constant-resistance support strength of the hydraulic support may be determined as $p_{s\text{-}dyn}=mp_{s\text{-}static}$ when energy-absorbing receding starts, and m is a support resistance gain coefficient (the value range of m may be 1.0 to 1.5, m may be 1.3 herein) of the energy absorber. Specifically, $p_{s\text{-}dyn}=1.3\times 0.3619=0.47047$ MPa.

Specifically, for the surrounding rock-support mutual feedback equilibrium curve (I-type curve) shown in FIG. 6, the support strength $p_{s\text{-}static}$ may be determined as 0.3619 MPa; and for the surrounding rock-support mutual feedback equilibrium curve (II-type curve) shown in FIG. 7, the support strength $p_{s\text{-}static}$ may be determined as 0.27 MPa.

Figure 10:
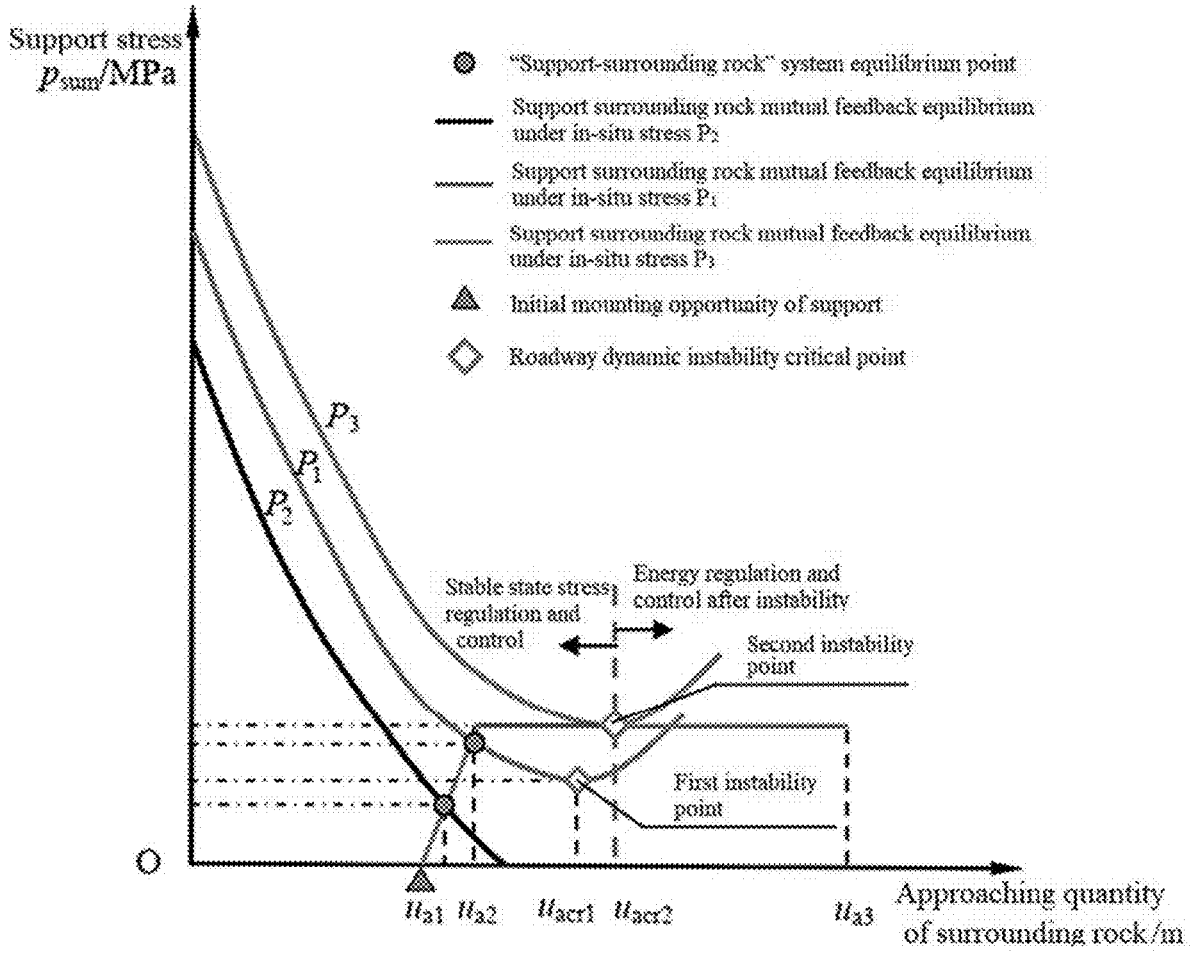
FIG. 10 is a roadway "surrounding rock-support" mutual feedback equilibrium characteristic curve under the action of the specific in-situ stress according to an embodiment of the present invention.

For the above Embodiment 1, although a dynamic instability point is not present in the near-field surrounding rock of the roadway under the action of $P_1$=24.76 MPa, if $P_1$ is increased to a certain value, an instability point will appear, and the specific determining process is the same as the process of the corresponding instability point in Embodiment 2. For Embodiment 2, a dynamic instability point (that is, the first instability point) appears in the near-field surrounding rock of the roadway under the action of $P_1$=47.62 MPa, when the in-situ stress $P_1$ is increased to a certain value (for example, $P_3$), a new instability point (that is, a second instability point) will appear, as shown in FIG. 10, the specific determining process is the same as the process of the corresponding instability point in Embodiment 2.

In conclusion, a first surrounding rock-support mutual feedback equilibrium curve under the first equivalent in-situ stress is determined according to a system equation of a roadway, a function relation between a displacement of surrounding rock of the roadway and a radius of a fracture zone, the first equivalent in-situ stress and a function relation between the first boundary stress of the fracture zone on the softening zone under the first equivalent in-situ stress and both of a first support strength required by the roadway space and the radius of the fracture zone; a first support equilibrium point of the first surrounding rock-support mutual feedback equilibrium curve is determined; and the support strength of the to-be-selected hydraulic support on the supporting rock is determined according to the first support equilibrium point and the stress of the anchoring support of the roadway. According to the present invention, the loading effect of the mining of the working face on the advanced roadway is considered, and the rock burst roadway "surrounding rock and support" deformation coordinated response and mutual feedback equilibrium relation can be quantitatively determined; therefore, the support strength of the to-be-selected hydraulic support on the surrounding rock can be accurately determined, and the parameterized model selection of the bursting-preventing hydraulic support of the roadway can be realized based on the support strength.

It is found in engineering practice that the high-strength roadway support is beneficial to improving the critical load of the starting of the roadway rock burst, so that rock burst is not prone to occur or the occurrence difficulty is not prone to increase. Therefore, the roadway support design technology, which is oriented to the pre-start of the burst and aims at the preventive treatment of rock burst, naturally becomes an important aspect of the prevention of the coal mine rock burst.

An embodiment of the present invention further provides a model selection method for a hydraulic support. The model selection method may include: determining a first support equilibrium point, a second support equilibrium point and a support strength of a to-be-selected hydraulic support on the surrounding rock according to the determining method for the support strength; determining a minimum expansion and contraction quantity required by a movable column in an upright column of the hydraulic support according to the first support equilibrium point and the second support equilibrium point; and determining the hydraulic support matched with the roadway, according to the support strength of the hydraulic support on the surrounding rock and the minimum expansion and contraction quantity required by the movable column in the upright column.

Specifically, for Embodiment 1, according to the x-coordinate $u_1$ of the second support equilibrium point $N_0$ and the x-coordinate $u_2$ of the first support equilibrium point $N_1$, the minimum expansion and contraction quantity required by the movable column in the upright column may be determined as follows: $L_{min}2(u_2-u_1)=2\times(0.1129\ m-0.03773\ m)=150.34$ mm. For Embodiment 2, according to the x-coordinate $u_{a1}$ of the second support equilibrium point $N_0$ and the x-coordinate $u_{a2}$ of the first support equilibrium point $S_0$, the minimum expansion and contraction quantity required by the movable column in the upright column may be determined as follows: $L_{min}=2(u_{a2}-u_{a1})=2\times(0.57\ m-0.08\ m)=980$ mm.

The step of determining the hydraulic support matched with the roadway may include: determining a static working load and an energy-absorbing receding resistance required by burst prevention of the hydraulic support according to the support strength of the hydraulic support on the surrounding rock; and selecting a model of the hydraulic support, according to the static working load and the energy-absorbing receding resistance required by burst prevention of the hydraulic support and the minimum expansion and contraction quantity required by the movable column in the upright column.

Specifically, the static working load $F_{s\text{-}static}$ required by burst prevention of the hydraulic support is determined according to the support strength $p_{s\text{-}static}$ of the hydraulic support on the surrounding rock, a distance $l_0$ between any two adjacent hydraulic supports, a width B of the roadway and $F_{s\text{-}static}=l_0Bp_{s\text{-}static}$. Then, the energy-absorbing receding resistance $F_{s\text{-}dny}$ required by burst prevention of the hydraulic support may be determined according to the static working load $F_{s\text{-}static}$ required by burst prevention of the hydraulic support and $F_{s\text{-}dny}=mF_{s\text{-}static}$.

For the two-column guide rod unit type energy-absorbing bursting-preventing hydraulic support, the distance between any two adjacent hydraulic supports is $l_0=2.5$ m, the width of the roadway is B=4.4 m, and the static working load $F_{s\text{-}static}=3980.9$ kN required by burst prevention of the support and the energy-absorbing receding resistance $F_{s\text{-}dny}=mF_{s\text{-}static}=1.3\times3980.9$ kN=5175.17 kN required by burst prevention of the hydraulic support are calculated by combining the support strength $p_{s\text{-}static}=0.3619$ Mpa (for the roadway in Embodiment 1) of the hydraulic support on the surrounding rock.

According to Table 3, the working resistance $F_w$ of the hydraulic support is 3300 kN and the energy-absorbing receding resistance $F_n$ is 3750 kN. The static working load ($F_{s\text{-}static}=3980.9$ kN) required by burst prevention of the support is greater than the working resistance ($F_w=3300$ kN) of the hydraulic support, and the energy-absorbing receding resistance ($F_{s\text{-}dny}=5175.17$ kN) required by burst prevention of the hydraulic support is greater than the energy-absorbing receding resistance ($F_n=3750$ kN) of the hydraulic support, so it can be concluded that the two-column guide rod unit type energy-absorbing bursting-preventing hydraulic support cannot meet the energy-absorbing and bursting-preventing requirements of the current roadway.

TABLE 3

Parameter table of two-column guide rod unit type energy-absorbing hydraulic support

| | Item | Parameter | Unit | Note |
|---|---|---|---|---|
| Energy-absorbing bursting-preventing parameter | Longitudinal burst receding average resistance $F_n$ | 3750 | kN | Deviation ±5% |
| | Longitudinal burst receding displacement $L_{imp}$ | 200 | mm | Design value |
| | Longitudinal burst receding absorbed energy $E_{imp}$ | 750 | kJ | Maximum value |
| | Burst receding speed | ≤10 | m/s | |
| Support | Height | 2300-4200 | mm | |
| | Initial support force | 2616 | kN | P = 31.5 MPa |
| | Working resistance $F_w$ | 3300 | kN | P = 39.8 MPa |
| | Support strength | 0.30 | MPa | Support area 4.4 × 2.5 ($m^2$) |
| | Floor load intensity | 4.21 | MPa | |
| | Adaptive inclination angle | ≤10° | | |
| | Pump station pressure | 31.5 | MPa | |
| | Operating mode | Local control | | |
| | Transportation dimension | 2400 × 720 × 2300 | mm | |
| | Weight | ≈5000 | kg | |

TABLE 3-continued

| Parameter table of two-column guide rod unit type energy-absorbing hydraulic support | | | | |
|---|---|---|---|---|
| | Item | Parameter | Unit | Note |
| Upright column | Upright column form | Double expansion and contraction | | Number: 2 |
| | Cylinder diameter | Φ230/φ180 | mm | |
| | Column diameter | Φ220/φ160 | mm | |
| | Pressure yielding stroke $L_{sta}$ of movable column | 1090 | mm | |
| | Initial support force | 1308 | kN | P = 31.5 MPa |
| | Working resistance | 1652 | kN | P = 39.8 MPa |

For the two-column guide-rod-free unit type energy-absorbing bursting-preventing hydraulic support, the distance between any two adjacent hydraulic supports is $l_0$=2.4 m, the width of the roadway is B=4.4 m, and the static working load $F_{s\text{-}static}$=3821.7 kN required by burst prevention of the support and the energy-absorbing receding resistance $F_{s\text{-}dny}$=m$F_{s\text{-}static}$=1.3×3821.7 kN=4968.21 kN required by burst prevention of the hydraulic support are calculated by combining the support strength $p_{s\text{-}static}$=0.3619 MPa (for the roadway in Embodiment 1) of the hydraulic support on the surrounding rock.

According to Table 4, the working resistance $F_w$ of the hydraulic support is 4000 kN and the energy-absorbing receding resistance $F_n$ is 6000 kN. The static working load ($F_{s\text{-}static}$=3821.7 kN) required by burst prevention of the support is less than the working resistance ($F_w$=4000 kN) of the hydraulic support, and the energy-absorbing receding resistance ($F_{s\text{-}dny}$=4968.21 kN) required by burst prevention of the hydraulic support is less than the energy-absorbing receding resistance (Fri 6000 kN) of the hydraulic support, so it can be concluded that the two-column guide-rod-free unit type energy-absorbing bursting-preventing hydraulic support can meet the energy-absorbing and bursting-preventing requirements of the current roadway.

According to Table 4, the pressure yielding stroke $L_{sta}$ of the movable column is 1900 mm. The minimum expansion and contraction quantity ($L_{min}$=150.34 mm) required by the movable column in the upright column is less than the pressure yielding stroke ($L_{sta}$=1900 mm) of the movable column. The above criteria show that the two-column guide-rod-free unit type energy-absorbing bursting-preventing hydraulic support can better meet the bursting-preventing and energy-absorbing requirements of the current roadway in the aspects such as the burst receding working resistance, the energy-absorbing receding resistance and the pressure yielding stroke of the movable column.

TABLE 4

| Parameter table of two-column guide-rod-free unit type energy-absorbing hydraulic support | | | | |
|---|---|---|---|---|
| | Item | Parameter | Unit | Note |
| Energy-absorbing bursting-preventing parameter | Longitudinal burst receding average resistance $F_n$ | 6000 | kN | Deviation ±5% |
| | Longitudinal burst receding displacement $L_{imp}$ | 120 | mm | Design value |
| | Longitudinal burst receding absorbed energy $E_{imp}$ | 720 | kJ | Maximum value |
| | Burst receding speed | ≤10 | m/s | |
| Support | Height | 2400-4000 | mm | |
| | Initial support force | 3090 | kN | P = 31.5 MPa |
| | Working resistance $F_w$ | 4000 | kN | P = 39.8 MPa |
| | Support strength | 0.38 | MPa | Support area 4.4 × 2.4 ($m^2$) |
| | Floor load intensity | 1.97 | MPa | |
| | Adaptive inclination angle | ≤10° | | |
| | Pump station pressure | 31.5 | MPa | |
| | Operating mode | Local control | | |
| | Transportation dimension | 2400 × 720 × 2300 | mm | |
| | Weight | ≈4500 | kg | |
| Upright column | Upright column form | Double expansion and contraction | | Number: 2 |
| | Cylinder diameter | Φ250/φ180 | mm | |
| | Column diameter | Φ235/φ160 | mm | |
| | Pressure yielding stroke $L_{sta}$ of movable column | 1900 | mm | |
| | Initial support force | 1545 | kN | P = 31.5 MPa |
| | Working resistance | 2000 | kN | P = 39.8 MPa |

For the gate type energy-absorbing bursting-preventing hydraulic support, the distance between any two adjacent hydraulic supports is $l_0$=5 m, the width of the roadway is B=5.2 m, and the static working load $F_{s\text{-}static}$=7020 kN required by burst prevention of the support is calculated by combining the support strength $p_{s\text{-}static}$=0.27 MPa (for the roadway in Embodiment 2) of the hydraulic support on the surrounding rock. The working resistance $F_w$-static of the gate type support is 6600 kN, so the static working load ($F_{s\text{-}static}$=7020 kN) required by burst prevention of the support is greater than the working resistance ($F_{w\text{-}static}$=6600 kN) of the gate type support. The above criteria show that using the gate type energy-absorbing support alone cannot meet the resistance requirement of bursting-preventing support.

Further, for the combination of the gate type energy-absorbing bursting-preventing hydraulic support and a stack type energy-absorbing support (for example, the gate type supports are interspersed with the stack type supports, which may be called a support combination), similarly, the static working load $F_{s\text{-}static}$=7020 kN required by burst prevention of the support may be determined. The working resistance $F_{w\text{-}static1}$ of the gate type support is 6600 kN, and the working resistance $F_{w\text{-}static2}$ of the stack type support is 4000 kN, so the static working load ($F_{s\text{-}static}$=7020 kN) required by burst prevention of the support is less than the total working resistance ($F_{w\text{-}static}$=10600 kN) of the gate type support and the stack type support.

Therefore, the combined support supporting design meets the strength bursting-preventing requirement, and the bursting-preventing safety coefficient $N_s=F_{w\text{-}static}/F_{s\text{-}static}$=1.51 can be obtained. For the combination of the gate type energy-absorbing bursting-preventing hydraulic support and the stack type energy-absorbing support (that is the support combination), the pressure yielding stroke $L_{sta}$ of the movable column is 1300 mm. To ensure the burst energy-absorbing stroke, whether the pressure yielding stroke of the movable column of the upright column of the support under static pressure meets the static pressure large deformation quantity of the roadway is checked. The criterion is as follows: the minimum expansion and contraction quantity ($L_{min}$980 mm) required by the movable column in the upright column is less than the pressure yielding stroke ($L_{sta}$=1300 mm) of the movable column, as shown in Table 5. The above criterion shows that the combination of the gate type energy-absorbing bursting-preventing hydraulic support and the stack type energy-absorbing support can better meet the bursting-preventing and energy-absorbing requirements of the current roadway in the aspects such as the burst receding working resistance, the energy-absorbing receding resistance and the pressure yielding stroke of the movable column.

TABLE 5

Mining roadway support design parameters and bursting-preventing safety coefficient

| Serial Number | Roadway Support Parameter | Symbol | Unit | Calculation Value |
|---|---|---|---|---|
| 1 | Support stress at instability point $S_0$ | $P_{scr}$ | MPa | 0.68 |
| 2 | Roadway side displacement at instability point $S_0$ | $u_{a2}$ | m | 0.57 |
| 3 | Roadway side displacement at equilibrium point $N_0$ | $u_{a1}$ | m | 0.08 |
| 4 | Anchoring and O-shaped shed support strength | $P_{other}$ | MPa | 0.39 |
| 5 | Support strength of support under static pressure | $p_{s\text{-}static}$ | MPa | 0.27 |
| 6 | Anchor net cable support coordinated coefficient | $\omega_1$ | — | 1.20 |
| 7 | Hydraulic support supporting coordinated coefficient | ω2 | — | 0.80 |
| 8 | Minimum displacement quantity under static load pressure yielding of movable column | $L_{min}$ | m | 0.98 |

TABLE 5-continued

Mining roadway support design parameters and bursting-preventing safety coefficient

| Serial Number | Roadway Support Parameter | Symbol | Unit | Calculation Value |
|---|---|---|---|---|
| 9 | Critical radius of fracture zone of surrounding rock instability | $\rho_{der}$ | m | 16.32 |
| 10 | Critical radius of softening zone of surrounding rock instability | $\rho_{per}$ | m | 19.37 |
| 11 | Energy consumption of softening fracture zone of surrounding rock | $E_{rock}$ | J/m | 4.11E+06 |
| 12 | Absorbed energy of single common anchor bolt | $E_{ubolt}$ | J | 2.08E+04 |
| 13 | Energy absorption of single common anchor cable | $E_{ucable}$ | J | 1.28E+05 |
| 14 | Energy absorption of single constant-resistance anchor cable | $E_{ubolt\text{-}con}$ | J | 5.25E+04 |
| 15 | Energy absorption of anchoring support of each meter of roadway | $E_{bolt\text{-}cable}$ | J/m | 4.71E+05 |
| 16 | Most dangerous energy release earthquake magnitude | $ML_{max}$ | — | 2.27 |
| 17 | Most dangerous energy release | $E_{max}$ | J | 7.7E+07 |
| 18 | Mine earthquake kinetic energy of surrounding rock of each meter of roadway | $E_c$ | J/m | 9.44E+05 |
| 19 | Energy release of surrounding rock of limit equilibrium area | $E_{cr}$ | J/m | 3.84E+06 |
| 20 | Distance between common supports | $l_0$ | m | 5.00 |
| 21 | Support width of roadway | B | m | 5.20 |
| 22 | Minimum resistance of static work of support | $F_{s\text{-}static}$ | kN | 7020 |
| 23 | Working resistance of to-be-selected support | $F_{w\text{-}static}$ | kN | 10600 |
| 24 | Residual burst energy of surrounding rock | $E_{residual}$ | J/m | 2.03E+05 |
| 25 | Energy needing to be absorbed by roadway support | $E_{support}$ | J | 1.02E+06 |
| 26 | Total energy absorbed by to-be-selected support | $E_{imp}$ | J | 1.66E+06 |
| 27 | Minimum receding stroke of energy absorber | $L_{str}$ | m | 0.74 |
| 28 | Minimum expansion and contraction quantity of movable column | $L_{min}$ | m | 0.98 |
| 29 | Bursting-preventing safety coefficient | $N_s$ | — | 1.51 |
| 30 | Burst-stopping safety coefficient | $N_e$ | — | 1.63 |

The model selection method further includes: determining an extension quantity of the movable column in the upright column according to ta selected hydraulic support and a height of the roadway; determining a rigidity of the selected hydraulic support according to the extension quantity of the movable column in the upright column; and determining an initial supporting opportunity, according to an initial support force, a working resistance and the rigidity of the selected hydraulic support and the second support equilibrium point.

Specifically, the height (such as 2.6 m) of the support is determined according to the model of the two-column guide-rod-free unit type bursting-preventing support; the determined height (such as 2.6 m) of the support is subtracted from the height H=3.2 m of the roadway to be subjected to support design to obtain the extension quantity h=0.6 m of the movable column in the upright column;

further, the rigidity $K_{support}$=2.33×10$^7$ N/m of the support may be determined according to the extension quantity h=0.6 m of the movable column; and the initial supporting opportunity (that is, the initial supporting surrounding rock approaching quantity) $u_0$ is determined by combining the initial support force $F_{initiate}$=3090 kN (as shown in Table 4) of the support, the working resistance $F_w$ of the support, the rigidity value $K_{support}$ of the support, the x-coordinate $u_1$ (that is, the displacement quantity of the surrounding rock of the roadway corresponding to the equilibrium point $N_0$ of the surrounding rock of the roadway and the support under the action of the second equivalent in-situ stress $P_2$) of the second support equilibrium point and the following formula:

$$u_0 = u_1 - \frac{1}{2}(F_w - F_{initiate})/K_{support} = 0.03773 - (4000 - 3090)/(2 * 2.33 \times 10^4) = 18.21 \text{ mm}.$$

Similarly, it may be determined that the mean value $K_{support}$ of the rigidity of the support combination is equal to 2.33×10$^7$ N/m; and the initial supporting opportunity (that is, the initial supporting surrounding rock approaching quantity) $u_{a0}$ is determined by combining the initial support force $F_{initiate}$=8070 kN of the support combination, the working resistance $F_{w\text{-}static}$ of the support combination, the rigidity value $K_{support}$ of the support combination, the x-coordinate $u_{a1}$ (that is, the displacement quantity of the surrounding rock of the roadway corresponding to the equilibrium point $N_0$ of the surrounding rock of the roadway and the support under the action of the second equivalent in-situ stress $P_2$) of the second support equilibrium point and the following formula:

$$u_{a0} = u_{a1} - \frac{1}{2}(F_{w\text{-}static} - F_{initiate})/K_{support} = 25.71 \text{ mm}.$$

The data in each of the above tables may be obtained through measurement or other existing methods.

An embodiment of the present invention further provides a determining system for a support strength. The determining system may include: a stress determining device, configured to determine a first equivalent in-situ stress of a mining influence area roadway and a second equivalent in-situ stress of a non-mining influence area roadway; an equilibrium curve determining device, configured to determine a first surrounding rock-support mutual feedback equilibrium curve under the first equivalent in-situ stress, according to a system equation of a roadway, a function relation between a displacement of surrounding rock of the roadway and a radius of a fracture zone, the first equivalent in-situ stress, and a function relation between a first boundary stress of the fracture zone under the first equivalent in-situ stress on a softening zone and both of a first support strength required by a roadway space and the radius of the fracture zone; an equilibrium point determining device, configured to determine a first support equilibrium point of the first surrounding rock-support mutual feedback equilibrium curve; and a support strength determining device, configured to determine a support strength of the to-be-selected hydraulic support on the surrounding rock according to the first support equilibrium point and the stress of the anchoring support of the roadway.

Optionally, the equilibrium point determining device is configured to determine a first support equilibrium point of the first surrounding rock-support mutual feedback equilibrium curve, including: in the case of no extreme point in the first surrounding rock-support mutual feedback equilibrium curve, determining the first support equilibrium point using the surrounding rock separation layer control condition according to the first surrounding rock-support mutual feedback equilibrium curve; or in the case of an extreme point in the first surrounding rock-support mutual feedback equilibrium curve, determining the extreme point of the first surrounding rock-support mutual feedback equilibrium curve as the first support equilibrium point.

Optionally, the equilibrium point determining device is further configured to determine a second support equilibrium point of the second surrounding rock-support mutual feedback equilibrium curve. Correspondingly, the step of determining a second support equilibrium point of the second surrounding rock-support mutual feedback equilibrium curve includes: determining the second support equilibrium point, according to the y-coordinate of the first support equilibrium point and the second surrounding rock-support mutual feedback equilibrium curve, wherein the y-coordinate of the first support equilibrium point is equal to the y-coordinate of the second support equilibrium point.

The specific details and benefits of the determining system for the support strength provided by the present invention may refer to the description of the above determining method for the support strength, which will not be elaborated herein.

An embodiment of the present invention further provides a model selection system for a hydraulic support. The model selection system may include: the determining system for the support strength, configured to determine a first support equilibrium point, a second support equilibrium point and a support strength of a to-be-selected hydraulic support on the surrounding rock; an expansion and contraction quantity determining device, configured to determine a minimum expansion and contraction quantity required by a movable column in an upright column of the hydraulic support according to the first support equilibrium point and the second support equilibrium point; and a hydraulic support determining device, configured to determine the hydraulic support matched with the roadway, according to the support strength of the hydraulic support on the surrounding rock and the minimum expansion and contraction quantity required by the movable column in the upright column.

The specific details and benefits of the model selection system for the hydraulic support provided by the present invention may refer to the description of the above model selection method for the hydraulic support, which will not be elaborated herein.

In conclusion, according to the present invention, a first support equilibrium point, a second support equilibrium point and a support strength of a to-be-selected hydraulic support on the surrounding rock are creatively determined according to the determining method for the support strength; a minimum expansion and contraction quantity required by a movable column in an upright column of the hydraulic support is determined according to the first support equilibrium point and the second support equilibrium point; and then the hydraulic support matched with the roadway is determined according to the support strength of the hydraulic support on the surrounding rock and the minimum expansion and contraction quantity required by the movable column in the upright column. According to the present invention, the accurate model selection of the bursting-preventing hydraulic support of the roadway may be realized based on the quantitative support strength required by the surrounding rock.

The existing energy-absorbing bursting-preventing support design method directly regards the maximum value or the dangerous value of the energy in the roadway far-field seismicity event as the essence of the rock burst and regards the attenuated vibration energy in the far field as the total energy released by the rock burst, so that the energy released by instability of the surrounding rock of the near-field roadway limit equilibrium area can be ignored, resulting in slightly low estimation of burst release energy.

Figure 8:
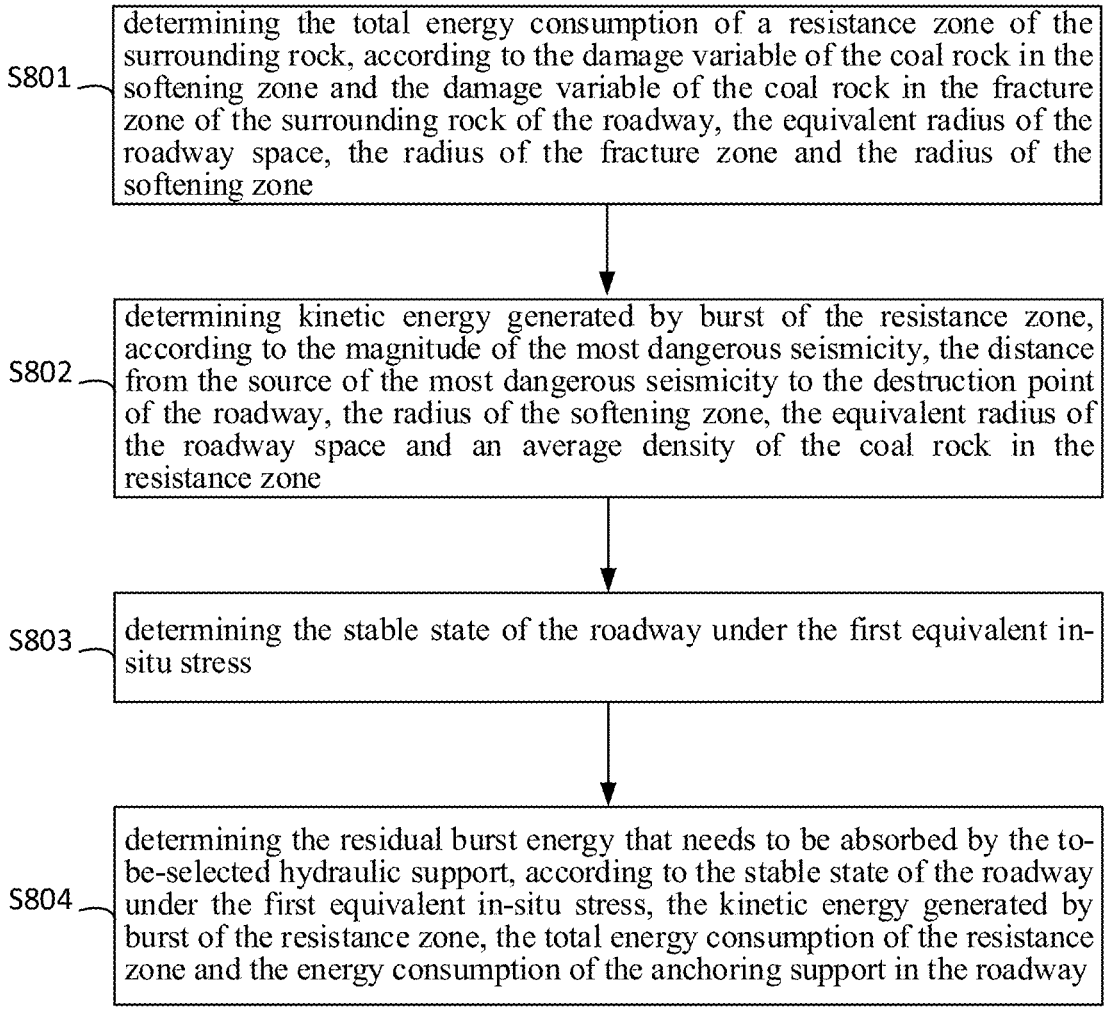
FIG. 8 is a flowchart of a determining method for residual burst energy according to an embodiment of the present invention.

FIG. 8 is a flowchart of a determining method for residual burst energy according to an embodiment of the present invention. As shown in FIG. 8, the determining method may include the following steps S801-S804.

Before the step S801 is performed, the determining method may further include: determining the radius of the fracture zone and the radius of the softening zone, according to the system equation of the roadway, the first equivalent in-situ stress, a disturbance response instability criterion, a damage variable of the coal rock in an elastic zone of the surrounding rock, the damage variable of the coal rock in the softening zone and the damage variable of the coal rock in the fracture zone.

Specifically, the radius $\rho_d$ of the fracture zone and the radius $\rho_p$ of the softening zone may be determined according to the system equation of the roadway shown in the equation (3), the first equivalent in-situ stress, a disturbance response instability criterion shown in the equation (6), and the damage variable $D_0$ of the coal rock in an elastic zone of the surrounding rock, the damage variable $D_1$ of the coal rock in the softening zone and the damage variable $D_2$ of the coal rock in the fracture zone that are shown in the equation (7) and listed from top to bottom.

$$\rho_p = \rho_d\sqrt{(1-\xi)E/\lambda_1 + 1} \tag{6}$$

$$\left.\begin{aligned} D_2 &= 1 - \left(1 - \frac{\rho_d^2}{\rho_2}\right)\gamma - \frac{\xi\rho_d^2}{\rho^2} \ (\rho < \rho_d) \\ D_1 &= \frac{\lambda_1}{E}\left(\frac{\rho_p^2}{\rho^2} - 1\right) \ (\rho_d < \rho < \rho_p) \\ D_0 &= 0 \ (\rho > \rho_p) \end{aligned}\right\} \tag{7}$$

wherein $\rho$ is the radius (m) of the surrounding rock of the roadway; and $\gamma$ is an intermediate variable, $$\gamma = \lambda_2/E + (1-\xi)\lambda_2/\lambda_1 + \xi, \ \frac{\rho_p}{\rho_d} = k$$

may be obtained through the formula (6). For example, for the roadway corresponding to the I-type curve shown in FIG. 6, the radius $\rho_d$=7.9 m of the fracture zone and the radius $\rho_p$=10.87 m of the softening zone of the surrounding rock of the roadway under the action of the first equivalent in-situ stress $P_1$ may be obtained.

Or the above radii (for example, the radius of the fracture zone and the radius of the softening zone) may be determined according to the existing mode.

Step S801: determining the total energy consumption of a resistance zone of the surrounding rock, according to the damage variable of the coal rock in the softening zone and the damage variable of the coal rock in the fracture zone of the surrounding rock of the roadway, the equivalent radius of the roadway space, the radius of the fracture zone and the radius of the softening zone.

The resistance zone includes the fracture zone and the softening zone.

Specifically, the total energy consumption $E_{rock}$ of the resistance zone of the surrounding rock may be determined according to the damage variable $D_1$ of the coal rock in the softening zone, the damage variable $D_2$ of the coal rock in the fracture zone, the equivalent radius $\rho_0$ of the roadway space, the radius $\rho_d$ of the fracture zone, the radius $\rho_p$ of the softening zone and the following formula (8) (that is, the minimum energy principle of coal rock dynamic destruction):

$$E_{rock} = \int_{\rho_d}^{\rho_p} 2\pi r\left(\frac{1}{2}[(1-D_1)\sigma_c + \xi\sigma_c][(1-D_1)\sigma_c - \xi\sigma_c]\frac{1}{\lambda_1} + \frac{(\xi\sigma_c)^2}{2\lambda_2}\right)dr + \int_{\rho_0}^{\rho_d} 2\pi r\frac{[(1-D_2)\sigma_c]^2}{2\lambda_2}dr \tag{8}$$

wherein $\sigma_c$ is the uniaxial compressive strength of the coal rock; is the residual strength coefficient; $\lambda_2$ is the residual falling modulus; and $\lambda_1$ is the softening falling modulus of the coal rock.

For the roadway (Embodiment 1) corresponding to the I-type curve shown in FIG. 6, the total energy consumption $E_{rock}$ of the resistance zone of the surrounding rock may be determined as 0.319856 MJ/m; and for the roadway (Embodiment 2) corresponding to the II-type curve shown in FIG. 7, the total energy consumption $E_{rock}$=4.11 MJ/m of the resistance zone of the surrounding rock may be determined.

In this step, the space range of the resistance zone of the surrounding rock may be quantitatively estimated when burst starts, so the dissipated energy of the surrounding rock may be estimated accurately, thereby greatly improving the stability of the roadway.

Step S802: determining kinetic energy generated by burst of the resistance zone, according to the magnitude of the most dangerous seismicity, the distance from the source of the most dangerous seismicity to the destruction point of the roadway, the radius of the softening zone, the equivalent radius of the roadway space and an average density of the coal rock in the resistance zone.

The step S802 of determining kinetic energy generated by burst of the resistance zone may include: determining a burst motion speed of the coal rock in the resistance zone when rock burst occurs, according to the magnitude of the most dangerous seismicity, the distance from the source of the most dangerous seismicity to the destruction point of the roadway, the radius of the softening zone and the equivalent radius of the roadway space; determining a mass of the coal rock in the resistance zone, according to the radius of the softening zone, the equivalent radius of the roadway space and the average density of the coal rock in the resistance zone; and determining the kinetic energy generated by the burst of the resistance zone, according to the burst motion speed and the mass of the coal rock in the resistance zone.

Specifically, the most dangerous historical burst event (the maximum value of equivalent burst event energy under the same epicentral distance) near the working face of the to-be-designed roadway is searched, and the magnitude $ML_{max}$ of the most dangerous seismicity and the distance $L_0$ from the source of the most dangerous seismicity to the destruction point of the roadway are recorded.

Then, the thickness $L_1=\rho_p-\rho_0$ of the resistance zone is determined according to the radius of the softening zone and the equivalent radius of the roadway space. Furthermore, the vibration peak value speed v' of a mass point of the surrounding rock at the outer boundary of the softening zone when rock burst occurs is calculated and obtained according to the following formula (9):

$$lg[(L_0-L_1)v']=3.95+0.57ML_{max}. \quad (9)$$

Under the condition that the vibration peak value speed v' is obtained, the burst motion speed of the coal rock in the resistance zone is v=2v'.

Then, the mass M of the coal rock in the resistance zone of the surrounding rock in the roadway per unit length is determined according to the radius $\rho_p$ of the softening zone, the equivalent radius $\rho_0$ of the roadway space, the average density $\rho_c$ of the coal rock in the resistance zone, and $$M = \rho_c \int_{\rho_0}^{\rho_p} 2\pi r dr.$$

Finally, the kinetic energy $E_e$ generated by the burst of the resistance zone is determined according to the burst motion speed v, the mass M of the coal rock in the resistance zone, and $$E_c = \frac{1}{2}Mv^2.$$

In Embodiment 1, the magnitude is obtained according to the relation between the magnitude of the seismicity and energy by using the far-field most dangerous burst-induced earthquake source energy $E_{max}=1.7\times10^7$ J monitored by a seismicity monitoring system. The distance from the most dangerous burst-induced earthquake source to the limit equilibrium area of the surrounding rock of the roadway is $L_0-L_1=30.84$ m, and the vibration peak value speed v'≈1.15 m/s of the mass point of the surrounding rock at the outer boundary of the rock coal in the softening zone when the burst-induced energy arrives at the limit equilibrium area of the roadway is calculated by a relational expression $lg[(L_0-L_1)v']=3.95+0.57\ ML_{max}$. The burst motion speed in the softening zone range of the roadway is v=2v'=2.3 m/s, and the density of the coal rock is $\rho_c=1.35\times10^3$ kg/m$^3$, then the mass M of the coal rock of the resistance zone of the roadway per unit length is:

$$M = 1.35\times10^3 \int_{2.7}^{10.87} 2\pi r dr = 469964.7891 \text{ kg}.$$

Based on this, $$E_c = \frac{1}{2}Mv^2 = 1.243056$$

MJ/m may be obtained.

In Embodiment 2, the magnitude $ML_{max}\leq2.27$ of the seismicity is obtained according to the relation between the magnitude of the seismicity and energy by using the far-field most dangerous burst-induced earthquake source energy $E_{max}=7.7\times10^7$ J monitored by the seismicity monitoring system. The distance from the most dangerous burst-induced earthquake source to the limit equilibrium area of the surrounding rock of the roadway is $L_0-L_1=32$ m, and the vibration peak value speed v'≈0.55 m/s of the mass point of the surrounding rock at the outer boundary of the rock coal in the softening zone when the burst-induced energy arrives at the limit equilibrium area of the roadway is calculated by a relational expression $lg[(L_0-L_1)v']=3.95+0.57\ ML_{max}$. The burst motion speed in the softening zone range of the roadway is v=2v'=A1.10 m/s, and the density of the coal rock is $\rho_c 1.35\times10^3$ kg/m$^3$, then the mass of the coal rock thrown in the resistance zone of the roadway per unit length is:

$$M = 1.35\times10^3 \int_{2.59}^{19.37} 2\pi r dr = 1.56E+06 \text{ kg}.$$

Based on this, the near-field coal rock throwing energy caused by far-field dynamic load in the roadway per unit length is:

$$E_c = \frac{1}{2}Mv^2 = 9.44\times10^5 \text{ J/m}.$$

Step S803: determining the stable state of the roadway under the first equivalent in-situ stress.

The first equivalent in-situ stress is an equivalent in-situ stress suffered by the mining influence area roadway A in the roadway, $P_1$ shown in FIG. 4 or FIG. 6.

The step S803 of determining the stable state (that is, whether the possibility of instability under the condition of high static load is present) of the roadway under the first equivalent in-situ stress may include: determining the surrounding rock-support mutual feedback equilibrium curve under the first equivalent in-situ stress, according to the system equation of the roadway, the function relation between the displacement of the surrounding rock of the roadway and the radius of the fracture zone, the first equivalent in-situ stress, and the function relation between the boundary stress of the fracture zone under the first equivalent in-situ stress on the softening zone and both of the support strength required by the roadway space and the radius of the fracture zone; and determining the stable state of the roadway under the first equivalent in-situ stress by the following modes: in the case of no extreme point in the surrounding rock-support mutual feedback equilibrium curve, determining the roadway does not have the unstable state under the first equivalent in-situ stress; or in the case of an extreme point in the surrounding rock-support mutual feedback equilibrium curve, determining the roadway has the unstable state under the first equivalent in-situ stress.

The step of determining the surrounding rock-support mutual feedback equilibrium curve under the first equivalent in-situ stress includes: determining the function relation between the first equivalent in-situ stress and the boundary stress according to the system equation of the roadway; and determining the surrounding rock-support mutual feedback equilibrium curve, according to the function relation between the first equivalent in-situ stress and the boundary stress, the function relation between the boundary stress and both of the support strength and the radius of the fracture zone, and the function relation between the displacement of the surrounding rock of the roadway and the radius of the fracture zone.

The above two processes may refer to the determination whether the extreme point $S_0$ is present above.

Step S804: determining the residual burst energy that needs to be absorbed by the to-be-selected hydraulic support, according to the stable state of the roadway under the first equivalent in-situ stress, the kinetic energy generated by burst of the resistance zone, the total energy consumption of the resistance zone and the energy consumption of the anchoring support in the roadway.

According to the stable state of the roadway under the condition of high static load, discussion is performed according to the following two cases.

Case 1 (Embodiment 1): under the condition that the roadway does not have the unstable state under the first equivalent in-situ stress, the step of determining the residual burst energy may include: subtracting a sum of the total energy consumption of the resistance zone and the energy consumption of the anchoring support from the kinetic energy generated by the burst of the resistance zone to obtain the residual burst energy.

Firstly, the process of estimating the energy consumption (for example, the energy consumption $E_{bolt\text{-}cable}$ of the anchoring support in the roadway per unit length) of the anchoring support is described.

For example, the anchor bolt adopted by the roadway is a threaded steel anchor bolt with the specification φ20×2500 mm (calculated according to the yield strength $\sigma_s \geq 380$ MPa and the extension rate $\delta_g \geq 15\%$). The energy-absorbing capability of the anchor bolt may be calculated according to the yield force and the extension quantity: the single anchor bolt absorbs energy $E_{ubolt}=\pi\phi^2\sigma_s\delta l_{bolt}/4=31.32$ kJ, wherein $l_{bolt}$ is the effective energy-absorbing length (1750 mm) of the anchor bolt.

The anchor cable adopted by the roadway is a steel strand with the specification φ=18.9 mm (according to the yield strength $\sigma_s \geq 1820$ MPa and the extension rate $\delta_s \geq 5\%$), the lengths of the anchor cables supported on the top plate and two sides are 10.50 m. The energy-absorbing capability of the anchor cable is calculated according to the yield force and the extension quantity, the single anchor cable absorbs energy $E_{ucable}=\pi\varphi_2\sigma_s\delta l_{cable}/4=186.29$ in the formula, $l_{cable}$ is the effective energy-absorbing length of the anchor cable.

Based on this, $$E_{bolt\text{-}cable} = \eta_{bolt}\frac{NE_{ubolt}}{S_{bolt}} + \eta_{cable}\frac{ME_{ucable}}{S_{cable}} = 0.3365\frac{9\times 31.32}{0.8} + 0.8935\frac{5\times 186.29}{1.6} = 0.6387\ \text{MJ/m}$$

may be estimated, in the formula, N is the number of one row of anchor bolts of the cross section of the roadway, and M is the number of one row of anchor cables; $S_{bolt}$ is the row distance of the anchor bolts, and $S_{cable}$ is the row distance of the anchor cables; and $\eta_{bolt}$ is the energy-absorbing efficiency of the anchor bolt, $$\eta_{bolt} = \frac{l_{bolt}}{\rho_d - \rho_0} = 33.65\%,$$

$\eta_{cable}$ is the energy-absorbing efficiency of the anchor cable, and $$\eta_{bolt} = \frac{l_{cable}}{\rho_p - \rho_0} = 89.35\%.$$

In the case of no possibility of instability of the roadway under the first equivalent in-situ stress, it is only necessary to consider the far-field disturbance energy (that is, for the roadway in which the surrounding rock of the roadway does not have the dynamic instability extreme point under the condition of the first equivalent in-situ stress, the burst energy of the far-field disturbance on the hydraulic support can be regarded as the destruction energy of rock burst). After the far-field disturbance energy is subjected to energy consumption of the resistance zone and the anchoring body, the hydraulic support needs to absorb the residual burst energy $E_{residual}=E_c-E_{bolt\text{-}cable}-E_{rock}=0.2845$ MJ/m.

Case 2 (Embodiment 2): in the case that the roadway has the unstable state under the first equivalent in-situ stress, the step of determining the residual burst energy may include: determining release energy of an elastic zone of the surrounding rock, according to the first equivalent in-situ stress, the y-coordinate of the extreme point of the surrounding rock-support mutual feedback equilibrium curve and an energy release rate of the elastic zone; and subtracting the sum of the total energy consumption of the resistance zone and the energy consumption of the anchoring support from a sum of the released energy of the elastic zone and the kinetic energy generated by the burst of the resistance zone to obtain the residual burst energy.

Firstly, the process of estimating the energy consumption (for example, the energy consumption $E_{bolt\text{-}cable}$ of the anchoring support in the roadway per unit length) of the anchoring support is described, and the energy absorbed by the O-shaped shed support may be ignored.

Through test and calculation, the energy $E_{ubolt}$ absorbed by the single traditional anchor bolt and the energy $E_{ucable}$ absorbed by the single traditional anchor cable are respectively: $E_{ubolt}$=2.08E+04 J; and $E_{ucable}$=1.28E+05 J. Through test and calculation, the energy absorbed by the reinforced constant-resistance anchor cable used by the roadway is: $E_{ucable\text{-}con}$=5.25E+04 J.

Based on this, the energy consumption $E_{bolt\text{-}cable}$ of the anchoring support in the roadway per unit length may be calculated as:

$$E_{bolt-cable} = \eta_{bolt}\frac{N_{ubolt}E_{ubolt}}{S_{bolt}} + \eta_{cable}\frac{M_{ucable}E_{ucable}}{S_{cable}} + \eta_{cable-con}\frac{M_{ucable\text{-}con}E_{ucable\text{-}con}}{S_{cable\text{-}con}} = 17.48\%\frac{8\times 2.08}{1.0} + 49.46\%\frac{6\times 12.80}{1.0} + 79.26\%\frac{3\times 5.25}{2.0} = 4.71E+05J$$

In the formula, $N_{ubolt}$ is the number of one row of common anchor bolts of the cross section of the roadway; $M_{ucable}$ and $M_{ucable\text{-}con}$ are respectively the numbers of one row of common anchor cables and one row of constant-resistance anchor bolts the cross section of the roadway; $S_{bolt}$ is the row distance of the common anchor bolts; and $S_{cable}$ and $S_{cable\text{-}con}$ are respectively the row distances of the common anchor cables and the constant-resistance anchor cables. The energy-absorbing efficiencies of the anchor bolt and the anchor cable are determined based on the gradient characteristic of softening and fracture of the surrounding rock: $\eta_{bolt}$ is the energy-absorbing efficiency of the common anchor bolt, $$\eta_{bolt} = \frac{l_{bolt}}{\rho_{dcr} - \rho_0} = \frac{2.4}{16.32 - 2.59} = 17.48\%;$$

$\eta_{cable}$ is the energy-absorbing efficiency of the traditional anchor cable, $$\eta_{cable} = \frac{l_{cable}}{\rho_{pcr} - \rho_0} = \frac{8.3}{19.37 - 2.59} = 49.46\%;$$

and $\eta_{cable\text{-}con}$ is the energy-absorbing efficiency of the constant-resistance anchor cable, $$\eta_{cable\text{-}con} = \frac{l_{cable\text{-}con}}{\rho_{pcr} - \rho_0} = \frac{13.3}{19.37 - 2.59} = 79.26\%.$$

Then, the released energy $E_{cr}$ of the elastic zone is determined according to the first equivalent in-situ stress $P_1$, the y-coordinate $p_{scr}$ of the extreme point $S_0$ of the surrounding rock-support mutual feedback equilibrium curve and the energy release rate $\eta$ of the elastic zone of the surrounding rock.

$$E_{cr} = \eta\pi\rho_0^2 \frac{1+\upsilon}{E} \frac{p_{scr}(q-1)+\alpha}{\beta}\left((1-\xi)\frac{E}{\lambda_1}+1\right)\left(\frac{(m-1)P_2+\sigma_c}{m+1}\right)^2 \quad (10)$$

wherein $$\alpha = \sigma_c\left[\frac{\lambda_2}{E} + \frac{\lambda_2}{\lambda_1}(1-\xi)+\xi\right],\ \beta = \sigma_c\left[\frac{\lambda_2}{E} + \frac{\lambda_2}{\lambda_1}(1-\xi)\right];\ p_{scr} = p_{sum},$$

which is the total support strength (MPa) of the support equipment in the roadway; q is an intermediate variable, $$q = \frac{1+\sin\varphi'}{1-\sin\varphi'},$$

$\varphi'$ is the internal friction angle of the surrounding rock of the fracture zone; and $\eta$ may be any one of 0.1%-1%. When $\eta$=1%, $E_{cr}=3.84\times10^6$ J/m.

In the case of the possibility of instability of the roadway under the first equivalent in-situ stress, it is necessary to consider the superposed energy of the far-field disturbance energy and the near-field roadway surrounding rock elastic energy. After the superposed energy is subjected to energy consumption of the resistance zone and the anchoring body, the hydraulic support needs to absorb the residual burst energy $E_{residual}=E_c+E_{cr}-E_{bolt\text{-}cable}-E_{rock}=2.03\chi10^5$ J/m. That is, support parameters are determined based on energy-absorbing and burst-stopping principle of energy conservation. The total energy absorbed by the energy-absorbing support is the burst energy of far-field disturbance on the support and the elastic energy released by the limit equilibrium area of the surrounding rock of the near-field roadway.

An embodiment of the present invention further provides a model selection method for a hydraulic support. The model selection method may include: determining the residual burst energy that needs to be absorbed by a to-be-selected hydraulic support according to the determining method for the residual burst energy; and determining the hydraulic support matched with the roadway according to the residual burst energy that needs to be absorbed by the hydraulic support.

The step of determining the hydraulic support matched with the roadway may include: determining an energy-absorbing receding stroke required by an energy absorber of the hydraulic support and energy that needs to be absorbed by a single support of the hydraulic support, according to the residual burst energy that needs to be absorbed by the hydraulic support; and selecting a model of the hydraulic support, according to the energy-absorbing receding stroke required by the energy absorber and the energy that needs to be absorbed by the single support.

Specifically, for a two-column guide-rod-free unit type energy-absorbing bursting-preventing hydraulic support, the energy-absorbing receding stroke $L_{str}=l_0E_{residual}/F_n$=2.4 m*0.2845 MJ/m/6000 kN=113.80 mm is determined according to the distance between any two adjacent hydraulic supports $l_0$($l_0$=2.4 m), the residual burst energy $E_{residual}$ ($E_{residual}$=0.2845 MJ/m) that needs to be absorbed by the hydraulic support and the energy-absorbing receding resistance ($F_n$=6000 kN) of the hydraulic support. The energy that needs to be absorbed by the hydraulic support is determined as $E_{support}$=0.2845 MJ/m*2.4 m=682.80 kJ according to the distance $l_0$($l_0$=2.4 m) between any two adjacent hydraulic supports and the residual burst energy $E_{residual}$($E_{residual}$=0.2845 MJ/m) that needs to be absorbed by the hydraulic support.

The energy-absorbing receding stroke $L_{str}$($L_{str}$=113.80 mm) of the hydraulic support is less than the burst receding displacement $L_{imp}$($L_{imp}$=120 mm) of the support, and the energy that needs to be absorbed by the single support $E_{support}$ ($E_{support}$=682.80 kJ) is less than the receding absorbed energy $E_{imp}$ ($E_{imp}$=720 Kj) of the single support, so the two-column guide-rod-free unit type energy-absorbing bursting-preventing hydraulic support can meet the energy-absorbing and bursting-preventing requirements of the current roadway in the aspects of the burst receding displacement and the burst receding absorbed energy.

Similarly, for the combination of the gate type energy-absorbing bursting-preventing hydraulic support and the stack type energy-absorbing support (that is, the support combination), the energy-absorbing receding stroke $L_{str}=l_0E_{residual}/1.3\ F_{w\text{-}static}$=73.66 mm of the hydraulic support is determined according to the distance $l_0$($l_0$=5 m) between any two adjacent hydraulic supports, the residual burst energy $E_{residual}$($E_{residual}=2.03\times10^5$ J/m) that needs to be absorbed by the hydraulic support and the energy-absorbing receding resistance ($F_{w\text{-}static}$−10600 kN) of the hydraulic support. The energy that needs to be absorbed by the hydraulic support is determined as $E_{support}=2.03\times10^5$ J/m*5 m=1.02 MJ according to the distance $l_0$($l_0$=5 m) between any two adjacent hydraulic supports and the residual burst energy $E_{residual}$($E_{residual}=2.03\times10^5$ J/m) that needs to be absorbed by the hydraulic support.

The energy-absorbing receding stroke $L_{str}$($L_{str}$=73.66 mm) of the hydraulic support is less than the burst receding displacement $L_{imp}$($L_{imp}$=120 mm) of the support, and the energy that needs to be absorbed by the single support $E_{support}$($E_{support}$=1.02 MJ) is less than the receding absorbed energy $E_{imp}$($E_{imp}$=1.66 MJ) of the single support, so the support combination can meet the energy-absorbing and bursting-preventing requirements of the current roadway in the aspects of the burst receding displacement and the burst receding absorbed energy, and the burst-stopping safety coefficient $N_e=E_{imp}/E_{support}$=1.63 can be obtained.

The model selection method may further include: determining an extension quantity of the movable column in the upright column is determined, according to a selected hydraulic support and a height of the roadway; determining a rigidity of the selected hydraulic support according to the extension quantity of the movable column in the upright column; and determining an initial supporting opportunity, according to an initial support force, a working resistance and the rigidity of the selected hydraulic support, and the support equilibrium point of the surrounding rock-support mutual feedback equilibrium curve under a second equivalent in-situ stress, wherein the second equivalent in-situ stress is an equivalent in-situ stress suffered by the non-mining influence area roadway.

A moving mechanism is configured to place the hydraulic support matched with the roadway in the roadway, such as at the initial supporting opportunity.

The model selection method may further include: determining a support equilibrium point of a surrounding rock-support mutual feedback equilibrium curve under the first equivalent in-situ stress and a support equilibrium point of a surrounding rock-support mutual feedback equilibrium curve under the second equivalent in-situ stress. Correspondingly, the step of determining a support equilibrium point of a surrounding rock-support mutual feedback equilibrium curve under the first equivalent in-situ stress includes: in the case of no extreme point in the surrounding rock-support mutual feedback equilibrium curve under the first equivalent in-situ stress, determining the support equilibrium point of the surrounding rock-support mutual feedback equilibrium curve under the first equivalent in-situ stress by using a surrounding rock separation layer control condition; or in the case of an extreme point in the surrounding rock-support mutual feedback equilibrium curve under the first equivalent in-situ stress, determining the extreme point of the surrounding rock-support mutual feedback equilibrium curve under the first equivalent in-situ stress as the support equilibrium point of the surrounding rock-support mutual feedback equilibrium curve under the first equivalent in-situ stress. The step of determining a support equilibrium point of the surrounding rock-support mutual feedback equilibrium curve under the second equivalent in-situ stress includes: determining the support equilibrium point of the surrounding rock-support mutual feedback equilibrium curve under the second equivalent in-situ stress, according to the y-coordinate of the support equilibrium point of the surrounding rock-support mutual feedback equilibrium curve under the first equivalent in-situ stress and the surrounding rock-support mutual feedback equilibrium curve under the second equivalent in-situ stress, wherein the y-coordinate of the support equilibrium point of the surrounding rock-support mutual feedback equilibrium curve under the first equivalent in-situ stress is equal to the y-coordinate of the support equilibrium point of the surrounding rock-support mutual feedback equilibrium curve under the second equivalent in-situ stress.

For the specific process, please refer to the above related description of determining the initial support opportunity.

An embodiment of the present invention further provides a determining system for residual burst energy. The determining system may include: an energy consumption determining device, configured to determine total consumption of a resistance zone of the surrounding rock according to a damage variable of coal rock in a softening zone and a damage variable of coal rock in a fracture zone of the surrounding rock of the roadway, an equivalent radius of the roadway space, a radius of the fracture zone and a radius of the softening zone, wherein the resistance zone includes the fracture zone and the softening zone; a kinetic energy determining device, configured to determine kinetic energy generated by burst of the resistance zone, according to the magnitude of the most dangerous seismicity, the distance from the source of the most dangerous seismicity to a destruction point of the roadway, the radius of the softening zone, the equivalent radius of the roadway space and the average density of the coal rock in the resistance zone; a state determining device, configured to determine the stable state of the roadway under a first equivalent in-situ stress, wherein the first equivalent in-situ stress is an equivalent in-situ stress of a mining influence area roadway; and a residual burst energy determining device, configured to determine the residual burst energy that needs to be absorbed by a to-be-selected hydraulic support, according to the stable state of the roadway under the first equivalent in-situ stress, the kinetic energy generated by the burst of the resistance zone, the total energy consumption of the resistance zone and the energy consumption of the anchoring support in the roadway.

The specific details and benefits of the system for determining the residual burst energy provided by the present invention may refer to the description of the above determining method for the residual burst energy, which will not be elaborated herein.

An embodiment of the present invention further provides a model selection system for a hydraulic support. The model selection system may include: the determining system for the residual burst energy, configured to determine the residual burst energy that needs to be absorbed by a to-be-selected hydraulic support; and a support determining device, configured to determine the hydraulic support matched with the roadway according to the residual burst energy that needs to be absorbed by the hydraulic support.

The specific details and benefits of the model selection system for the hydraulic support provided by the present invention may refer to the description of the above model selection method for the hydraulic support, which will not be elaborated herein.

In conclusion, according to the present invention, the total consumption of the resistance zone of the surrounding rock is creatively determined according to the damage variable of the coal rock in the softening zone and the damage variable of the coal rock in the fracture zone of the surrounding rock of the roadway, the equivalent radius of the roadway space, the radius of the fracture zone and the radius of the softening zone; the kinetic energy generated by burst of the resistance zone is determined according to the magnitude of the most dangerous seismicity, the distance from the source of the most dangerous seismicity to the destruction point of the roadway, the radius of the softening zone, the equivalent radius of the roadway space and the average density of the coal rock in the resistance zone; the stable state of the roadway under the first equivalent in-situ stress is determined; and then the residual burst energy that needs to be absorbed by the to-be-selected hydraulic support is determined according to the stable state of the roadway under the first equivalent in-situ stress, the kinetic energy generated by the burst of the resistance zone, the total energy consumption of the resistance zone and the energy consumption of the anchoring support in the roadway. According to the present invention, the residual burst energy that needs to be absorbed by the to-be-selected hydraulic support can be quantitatively determined by considering the superposition process of "far-field release disturbance energy of the roadway" and "near-field release energy of the roadway" when the rock burst of the roadway occurs, so that the parameterized model selection of the bursting-preventing hydraulic support can be realized based on the residual burst energy.

How to determine the related characteristic parameters (for example, the support strength of the hydraulic support on the surrounding rock or the residual burst energy that needs to be absorbed by the hydraulic support) of the hydraulic support are described respectively from two aspects of "prevention" (performing model selection on the hydraulic support based on the support strength before the burst starts) and "treatment" (performing model selection on the hydraulic support based on the residual burst energy after the burst starts). In fact, the two aspects of "prevention" and "treatment" may be combined to firstly determine the support strength of the hydraulic support on the surrounding rock and the residual burst energy that needs to be absorbed by the hydraulic support and then determine the hydraulic support matched with the roadway according to the determined support strength and residual burst energy.

Figure 9:
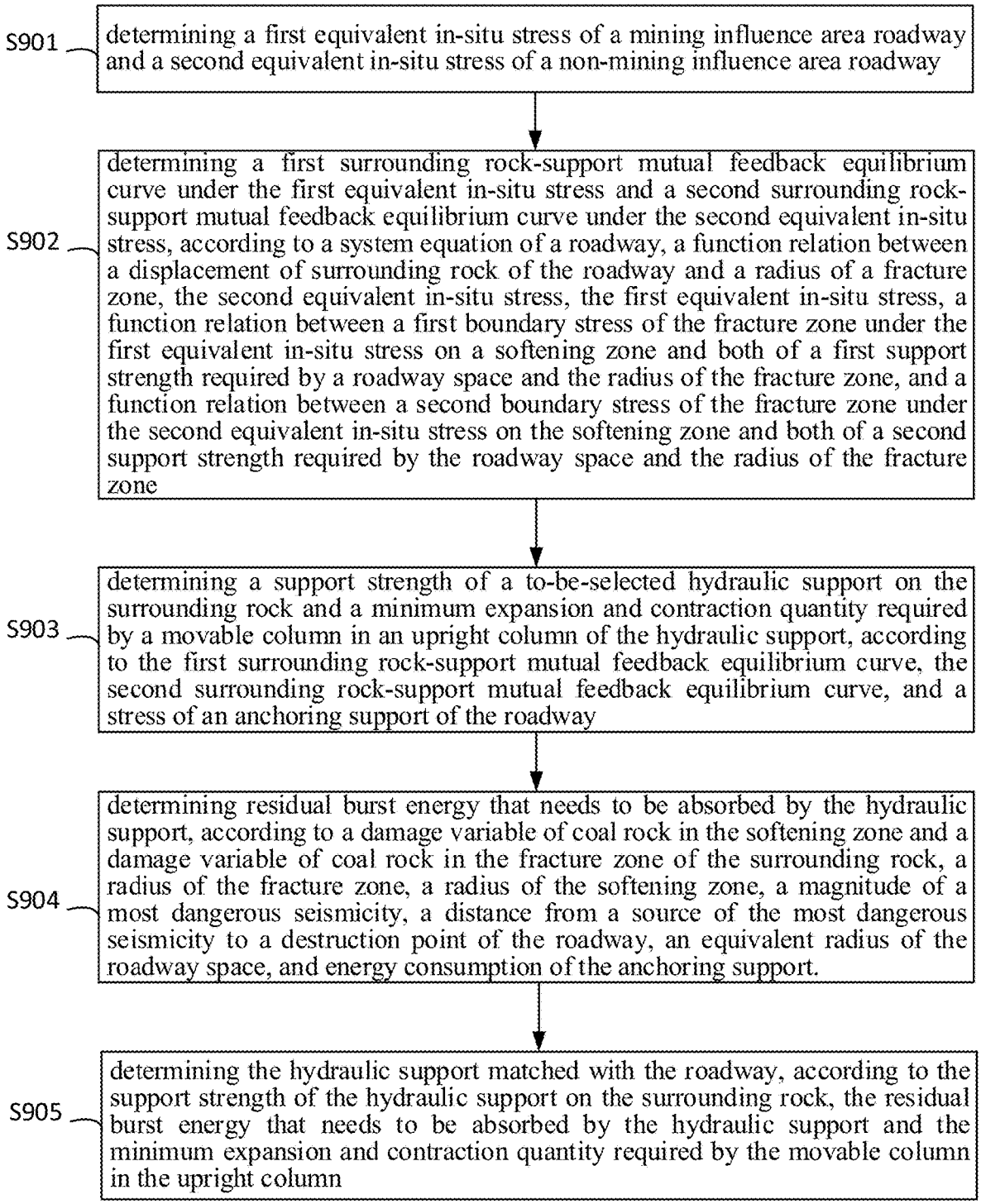
FIG. 9 is a flowchart of a model selection method according to an embodiment of the present invention.

An embodiment of the present invention further provides a model selection method for a hydraulic support. As shown in FIG. 9, the model selection method may include the following steps S901-S905.

Step S901: determining a first equivalent in-situ stress of a mining influence area roadway and a second equivalent in-situ stress of a non-mining influence area roadway.

Step S902: determining a first surrounding rock-support mutual feedback equilibrium curve under the first equivalent in-situ stress and a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress, the first equivalent in-situ stress, a function relation between a first boundary stress of the fracture zone under the first equivalent in-situ stress on a softening zone and both of a first support strength required by a roadway space and the radius of the fracture zone, and a function relation between a second boundary stress of the fracture zone under the second equivalent in-situ stress on the softening zone and both of a second support strength required by the roadway space and the radius of the fracture zone.

Step S903: determining a support strength of a to-be-selected hydraulic support on the surrounding rock and a minimum expansion and contraction quantity required by a movable column in an upright column of the hydraulic support, according to the first surrounding rock-support mutual feedback equilibrium curve, the second surrounding rock-support mutual feedback equilibrium curve, and a stress of an anchoring support of the roadway.

Step S904: determining residual burst energy that needs to be absorbed by the hydraulic support, according to a damage variable of coal rock in the softening zone and a damage variable of coal rock in the fracture zone of the surrounding rock, a radius of the fracture zone, a radius of the softening zone, a magnitude of a most dangerous seismicity, a distance from a source of the most dangerous seismicity to a destruction point of the roadway, an equivalent radius of the roadway space, and energy consumption of the anchoring support.

Step S905: determining the hydraulic support matched with the roadway, according to the support strength of the hydraulic support on the surrounding rock, the residual burst energy that needs to be absorbed by the hydraulic support and the minimum expansion and contraction quantity required by the movable column in the upright column.

The above embodiment provides an energy-absorbing hydraulic support design and model selection method from the two aspects of strength design (bursting-preventing/"prevention") and energy design (burst stopping/"treatment") on the basis of further considering "surrounding rock-support" system coordinated deformation and mutual feedback response, thereby ensuring the scientific operation of the bursting-preventing support equipment under a reasonable safety coefficient.

The specific process of determining the support strength, the residual burst energy and the minimum extension and contraction quantity may refer to the related description in the above "prevention" or "treatment" solution.

The step of determining the hydraulic support matched with the roadway may include: determining a static working load and an energy-absorbing receding resistance required by burst prevention of the hydraulic support, according to the support strength of the hydraulic support on the surrounding rock; determining an energy-absorbing receding stroke required by an energy absorber of the hydraulic support and energy that needs to be absorbed by a single support of the hydraulic support are determined, according to the residual burst energy that needs to be absorbed by the hydraulic support; and selecting a model of the hydraulic support is selected, according to the static working load and the energy-absorbing receding resistance required by burst prevention of the hydraulic support, the energy-absorbing receding stroke required by the energy absorber of the hydraulic support and the energy that needs to be absorbed by the single support of the hydraulic support, and the minimum expansion and retraction quantity required by the movable column in the upright column.

The specific process of determining the static working load, the energy-absorbing receding resistance, the energy-absorbing receding stroke, the energy needing to be absorbed and the minimum extension and contraction quantity may refer to the related description in the above "prevention" or "treatment" solution. Then, the model of the hydraulic support may be comprehensively selected by combining the determined five parameters and the corresponding criteria.

Therefore, it may be determined that the two-column guide-rod-free unit type energy-absorbing bursting-preventing hydraulic support (or the combination of the gate type and stack type supports) completely meets the requirements of the current roadway bursting-preventing/burst-stopping response on the energy-absorbing support in the aspects of strength and energy in the aspects of burst receding working resistance, burst receding displacement, burst receding absorbed energy, static working load and pressure yielding stroke of the movable column.

After the applicability determination of a plurality or all of the supports is completed, if a plurality of models meet the requirements, the selection is further optimized from the aspects of the specific pressure to the ground and the dumping prevention of the support; and if model selection of the support cannot be completed because the energy-absorbing parameter design determined by calculation cannot be matched with the existing support model database, it is necessary to implement new parameter design of the support.

After the coal seam area or local pressure relief work is enhanced, the first equivalent in-situ stress $P_1$ is re-estimated under the influence of the mining working face, other related steps are performed to realize cycle calculation until all the strength parameters and energy-absorbing parameters are reasonably determined or the to-be-designed working condition requirements are met by a support ordering mode. The withdrawing criterion of the cycle model selection may be one or more of the followings: the working resistance of the existing support is greater than or equal to the static working load required by burst prevention of the support; the energy-absorbing receding resistance of the existing support is greater than or equal to the energy-absorbing receding resistance required by burst prevention of the support; the pressure yielding stroke (that is, the maximum extension length) of the existing support is greater than the minimum extension and contraction quantity required by the movable column in the upright column; the burst receding displacement of the existing support is greater than or equal to the energy-absorbing receding displacement of the support; and the burst absorbed energy of the existing support is greater than the energy needing to be absorbed by the support.

In conclusion, according to the present invention, a second equivalent in-situ stress of a non-mining influence area roadway and a first equivalent in-situ stress of a mining influence area roadway are creatively determined; a first surrounding rock-support mutual feedback equilibrium curve under the first equivalent in-situ stress and a second surrounding rock-support mutual feedback equilibrium curve under the second equivalent in-situ stress are determined according to a system equation of a roadway, a function relation between a displacement of surrounding rock of the roadway and a radius of a fracture zone, the second equivalent in-situ stress, the first equivalent in-situ stress, a function relation between a first support strength required by a first boundary stress of a fracture zone under the first equivalent in-situ stress on a softening zone and a roadway space and the radius of the fracture zone, and a function relation between a second support strength required by a second boundary stress of a fracture zone under the second equivalent in-situ stress on the softening zone and the roadway space and the radius of the fracture zone; a support strength of a to-be-selected hydraulic support on the surrounding rock and a minimum expansion and contraction quantity required by a movable column in an upright column of the hydraulic support are determined according to the first surrounding rock-support mutual feedback equilibrium curve, the second surrounding rock-support mutual feedback equilibrium curve, and a stress of an anchoring support of the roadway; the residual burst energy that needs to be absorbed by the hydraulic support is determined according to a damage variable of coal rock in the softening zone and a damage variable of coal rock in the fracture zone of the surrounding rock, a radius of the fracture zone, a radius of the softening zone, the magnitude of the most dangerous seismicity, a distance from the source of the most dangerous seismicity to a destruction point of the roadway, an equivalent radius of the roadway space, and energy consumption of the anchoring support; and the hydraulic support matched with the roadway is determined according to the support strength of the hydraulic support on the surrounding rock, the residual burst energy that needs to be absorbed by the hydraulic support and the minimum expansion and contraction quantity required by the movable column in the upright column. Therefore, according to the present invention, on one hand, the loading effect of the mining of the working face on the advanced roadway is considered, and a "surrounding rock and support" deformation coordinated response and mutual feedback equilibrium relation of the roadway in which rock burst occurs can be quantitatively determined; and on the other hand, the superposition process of "far-field release disturbance energy of the roadway" and "near-field release energy of the roadway" when rock burst occurs is also considered, and the residual burst energy that needs to be absorbed by the to-be-selected hydraulic support can be quantitatively determined. Therefore, the support strength of the to-be-selected hydraulic support on the surrounding rock and the residual burst energy can be accurately determined, thereby achieving parameterized model selection of the bursting-preventing hydraulic support of the roadway at least based on the support strength and the residual burst energy.

An embodiment of the present invention further provides a model selection system for a hydraulic support. The model selection system may include: a stress determining device, configured to determine a first equivalent in-situ stress of a mining influence area roadway and a second equivalent in-situ stress of a non-mining influence area roadway; an equilibrium curve determining device, configured to determine a first surrounding rock-support mutual feedback equilibrium curve under the first equivalent in-situ stress and a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress, the first equivalent in-situ stress, a function relation between a first boundary stress of the fracture zone under the first equivalent in-situ stress on a softening zone and both of a first support strength required by a roadway space and the radius of the fracture zone, and a function relation between a second boundary stress of a fracture zone under the second equivalent in-situ stress on the softening zone and both of a second support strength required by the roadway space and the radius of the fracture zone; an expansion and contraction quantity determining device, configured to determine a support strength of a to-be-selected hydraulic support on the surrounding rock and a minimum expansion and contraction quantity required by a movable column in an upright column of the hydraulic support according to the first surrounding rock-support mutual feedback equilibrium curve, the second surrounding rock-support mutual feedback equilibrium curve, and a stress of an anchoring support of the roadway; a residual burst energy determining device, configured to determine the residual burst energy that needs to be absorbed by the hydraulic support, according to a damage variable of coal rock in the softening zone and a damage variable of coal rock in the fracture zone of the surrounding rock, a radius of the fracture zone, a radius of the softening zone, a magnitude of a most dangerous seismicity, a distance from a source of the most dangerous seismicity to a destruction point of the roadway, an equivalent radius of the roadway space, and energy consumption of the anchoring support; and a hydraulic support determining device, configured to determine the hydraulic support matched with the roadway, according to the support strength of the hydraulic support on the surrounding rock, the residual burst energy that needs to be absorbed by the hydraulic support and the minimum expansion and contraction quantity required by the movable column in the upright column.

The specific details and benefits of the model selection system for the hydraulic support provided by the present invention may refer to the description of the above model selection method for the hydraulic support, which will not be elaborated herein.

An embodiment of the present invention further provides a computer-readable storage medium. The computer-readable storage medium stores a computer program. When the computer program is executed by the processor, the model selection method for a hydraulic support is implemented.

It should be noted that the steps performed by each device in the model selection system or the determining system may be performed by the processor.

The beneficial effects of the above embodiments of the present invention at least include the following three contents:

Firstly, a model selection method for a bursting-preventing energy-absorbing hydraulic support of a roadway in which the rock burst occurs is provided. According to the method, the physical process of static and dynamic stresses and energy superposition of near-field and far-field surrounding rock when the rock burst occurs in the roadway is defined on the basis of the quantified roadway rock burst occurrence theory and the critical condition theoretical calculation formula, thereby laying a solid cognitive foundation of the rock burst physical process for the model selection of the bursting-preventing support.

Secondly, the quantitative estimation of "far-field release disturbance energy of the roadway" and "near-field release energy of the roadway" is realized by considering the method of combining analytical calculation and engineering statistics, and the feasibility and applicability criterion of the energy-absorbing bursting-preventing support design and the design method thereof are given comprehensively. The scientific mathematical calculation method and basis are laid for the model selection of the bursting-preventing support.

Thirdly, the "surrounding rock and support" mutual feedback equilibrium deformation coordinated response relation of roadway in which the rock burst occurs is fully considered, thereby effectively guiding and realizing the parameterized model selection of the support equipment based on stability, such as energy-absorbing resistance, receding stroke, support rigidity, initial support force and other parameters.

The optional implementation manners of the embodiments of the present invention are described above in detail with reference to the drawings; however, the embodiments of the present invention are not limited to the specific details of the above implementation manners. Within the scope of the technical concept of the embodiments of the present invention, various simple variations may be made to the embodiments of the present invention, which belong to the protection scope of the embodiments of the present invention.

In addition, it should be noted that various specific technical features described in the specific implementation manners may be combined in any appropriate ways without contradiction. To avoid unnecessary repetition, various possible combinations are not described separately in embodiments of the present invention.

Those skilled in the art may understand that all or some of steps for implementing the methods of the foregoing embodiments may be completed by instructing relevant hardware through a program. The program is stored in a storage medium and includes a plurality of instructions for enabling a single chip, a chip or a processor to perform all or some of steps in the method of each embodiment of the present application. The foregoing storage medium includes: any medium that can store program code, such as a USB flash disk, a removable hard disk, a read-only memory (ROM), a random access memory (RAM), a magnetic disk, or an optical disc.

In addition, various different implementation manners of the present invention may be combined arbitrarily, which should be regarded as the contents disclosed by the embodiments of the present invention, as long as they do not violate the idea of the embodiments of the present invention.

The invention claimed is:

1. A model selection method for a hydraulic support, comprising:

determining a first equivalent in-situ stress of a mining influence area roadway and a second equivalent in-situ stress of a non-mining influence area roadway;

determining a first surrounding rock-support mutual feedback equilibrium curve under the first equivalent in-situ stress and a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress, the first equivalent in-situ stress, a function relation between a first boundary stress of the fracture zone under the first equivalent in-situ stress on a softening zone and both of a first support strength required by a roadway space and the radius of the fracture zone, and a function relation between a second boundary stress of the fracture zone under the second equivalent in-situ stress on the softening zone and both of a second support strength required by the roadway space and the radius of the fracture zone;

determining a support strength of a to-be-selected hydraulic support on the surrounding rock and a minimum expansion and contraction quantity required by a movable column in an upright column of the hydraulic support, according to the first surrounding rock-support mutual feedback equilibrium curve, the second surrounding rock-support mutual feedback equilibrium curve, and a stress of an anchoring support of the roadway;

determining residual burst energy that needs to be absorbed by the hydraulic support, according to a damage variable of coal rock in the softening zone and a damage variable of coal rock in the fracture zone of the surrounding rock, the radius of the fracture zone, a radius of the softening zone, a magnitude of a most dangerous seismicity, a distance from a source of the most dangerous seismicity to a destruction point of the roadway, an equivalent radius of the roadway space, and energy consumption of the anchoring support; and determining the hydraulic support matched with the roadway, according to the support strength of the hydraulic support on the surrounding rock, the residual burst energy that needs to be absorbed by the hydraulic support and the minimum expansion and contraction quantity required by the movable column in the upright column.

2. The model selection method according to claim 1, wherein the determining a first surrounding rock-support mutual feedback equilibrium curve under the first equivalent in-situ stress and a second surrounding rock-support mutual feedback equilibrium curve under the second equivalent in-situ stress comprises:

determining the first boundary stress corresponding to the first equivalent in-situ stress and the second boundary stress corresponding to the second equivalent in-situ stress according to the system equation of the roadway;

determining the first surrounding rock-support mutual feedback equilibrium curve, according to the first boundary stress, the function relation between the first boundary stress and both of the first support strength and the radius of the fracture zone, and the function relation between the displacement of the surrounding rock of the roadway and the radius of the fracture zone; and determining the second surrounding rock-support mutual feedback equilibrium curve, according to the second boundary stress, the function relation between the second boundary stress and both of the second support strength and the radius of the fracture zone, and the function relation between the displacement of the surrounding rock of the roadway and the radius of the fracture zone.

3. The model selection method according to claim 1, wherein the determining a support strength of a to-be-selected hydraulic support on the surrounding rock and a minimum expansion and contraction quantity required by a movable column in an upright column of the hydraulic support comprises:

determining a first support equilibrium point of the first surrounding rock-support mutual feedback equilibrium curve and a second support equilibrium point of the second surrounding rock-support mutual feedback equilibrium curve, according to the first surrounding rock-support mutual feedback equilibrium curve and the second surrounding rock-support mutual feedback equilibrium curve;

determining the support strength of the hydraulic support on the surrounding rock, according to the second support equilibrium point and the stress of the anchoring support of the roadway; and determining the minimum expansion and contraction quantity required by the movable column in the upright column of the hydraulic support, according to the first support equilibrium point and the second support equilibrium point.

4. The model selection method according to claim 3, wherein the determining a first support equilibrium point of the first surrounding rock-support mutual feedback equilibrium curve and a second support equilibrium point of the second surrounding rock-support mutual feedback equilibrium curve comprises:

in the case of no extreme point in the first surrounding rock-support mutual feedback equilibrium curve, performing the following steps:

determining the first support equilibrium point by using a surrounding rock separation layer control condition, according to the first surrounding rock-support mutual feedback equilibrium curve; and determining the second support equilibrium point, according to a y-coordinate of the first support equilibrium point and the second surrounding rock-support mutual feedback equilibrium curve, or in the case of an extreme point in the first surrounding rock-support mutual feedback equilibrium curve, performing the following steps:

determining the extreme point of the first surrounding rock-support mutual feedback equilibrium curve as the first support equilibrium point; and determining the second support equilibrium point, according to the y-coordinate of the first support equilibrium point and the second surrounding rock-support mutual feedback equilibrium curve, wherein the y-coordinate of the first support equilibrium point is equal to a y-coordinate of the second support equilibrium point.

5. The model selection method according to claim 4, wherein the surrounding rock separation layer control condition comprises: the displacement of the surrounding rock of the roadway is less than or equal to a preset ratio of the equivalent radius of the roadway space.

6. The model selection method according to claim 3, wherein the determining residual burst energy that needs to be absorbed by the hydraulic support comprises:

determining total energy consumption of a resistance zone of the surrounding rock, according to the damage variable of the coal rock in the softening zone, the damage variable of the coal rock in the fracture zone, the equivalent radius of the roadway space, the radius of the fracture zone and the radius of the softening zone, wherein the resistance zone comprises the fracture zone and the softening zone;

determining kinetic energy generated by burst of the resistance zone, according to the magnitude of the most dangerous seismicity, the distance from the source of the most dangerous seismicity to the destruction point of the roadway, the radius of the softening zone, the equivalent radius of the roadway space and an average density of the coal rock in the resistance zone; and determining the residual burst energy, according to the kinetic energy generated by the burst of the resistance zone, the total energy consumption of the resistance zone and the energy consumption of the anchoring support.

7. The model selection method according to claim 6, wherein in the case of no extreme point in the second surrounding rock-support mutual feedback equilibrium curve, the determining the residual burst energy comprises:

subtracting a sum of the total energy consumption of the resistance zone and the energy consumption of the anchoring support from the kinetic energy generated by the burst of the resistance zone to obtain the residual burst energy.

8. The model selection method according to claim 6, wherein in the case of an extreme point in the second surrounding rock-support mutual feedback equilibrium curve, the determining the residual burst energy comprises:

determining released energy of an elastic zone of the surrounding rock, according to the first equivalent in-situ stress, the y-coordinate of the second support equilibrium point and an energy release rate of the elastic zone; and subtracting the sum of the total energy consumption of the resistance zone and the energy consumption of the anchoring support from a sum of the released energy of the elastic zone and the kinetic energy generated by the burst of the resistance zone to obtain the residual burst energy.

9. The model selection method according to claim 6, wherein the determining kinetic energy generated by burst of the resistance zone comprises:

determining an burst motion speed of the coal rock in the resistance zone when rock burst occurs, according to the magnitude of the most dangerous seismicity, the distance from the source of the most dangerous seismicity to the destruction point of the roadway, the radius of the softening zone and the equivalent radius of the roadway space;

determining a mass of the coal rock in the resistance zone, according to the radius of the softening zone, the equivalent radius of the roadway space and the average density of the coal rock in the resistance zone; and determining the kinetic energy generated by the burst of the resistance zone, according to the burst motion speed and the mass of the coal rock in the resistance zone.

10. The model selection method according to claim 1, wherein the determining a first equivalent in-situ stress of a mining influence area roadway and a second equivalent in-situ stress of a non-mining influence area roadway comprises:

determining a mining-induced stress peak value $P_m$ in the surrounding rock of the non-mining influence area roadway, according to an in-situ stress $P_0$, a uniaxial compressive strength $\sigma_c$ of the coal rock and the following formula;

$$P_m = 1.5P_0 + \frac{\sigma_c}{4};$$

determining the second equivalent in-situ stress $P_2$, according to the mining-induced stress peak value $P_m$, a pressure relief efficiency coefficient $W_{drill}$ of the surrounding rock, the uniaxial compressive strength $\sigma_c$ of the coal rock and the following formula, $$P_m W_{drill} = 1.5P_2 + \frac{\sigma_c}{4};$$

and determining the first equivalent in-situ stress $P_1$ according to the mining-induced stress peak value $P_m$, the pressure relief efficiency coefficient $W_{drill}$ of the surrounding rock of the roadway, a mining-induced stress concentration coefficient $\lambda_m$ of the mining influence area roadway, the uniaxial compressive strength $\sigma_c$ of the coal rock and the following formula, $$\lambda_m P_m W_{drill} = 1.5P_1 + \frac{\sigma_c}{4}.$$

11. The model selection method according to claim 1, further comprising:

determining the radius of the fracture zone and the radius of the softening zone, according to the system equation of the roadway, the first equivalent in-situ stress, a disturbance response instability criterion, the damage variable of the coal rock in the elastic zone of the surrounding rock, the damage variable of the coal rock in the softening zone and the damage variable of the coal rock in the fracture zone.

12. The model selection method according to claim 1, wherein the determining the hydraulic support matched with the roadway comprises:

determining a static working load and an energy-absorbing receding resistance required by burst prevention of the hydraulic support, according to the support strength of the hydraulic support on the surrounding rock;

determining an energy-absorbing receding stroke required by an energy absorber of the hydraulic support and energy that needs to be absorbed by a single support of the hydraulic support, according to the residual burst energy that needs to be absorbed by the hydraulic support; and selecting a model of the hydraulic support, according to the static working load and the energy-absorbing receding resistance required by burst prevention of the hydraulic support, the energy-absorbing receding stroke required by the energy absorber, the energy that needs to be absorbed by the single support and the minimum expansion and retraction quantity required by the movable column in the upright column.

13. The model selection method according to claim 12, further comprising:

determining an extension quantity of the movable column in the upright column, according to a selected hydraulic support and a height of the roadway;

determining a rigidity of the selected hydraulic support according to the extension quantity of the movable column in the upright column; and determining an initial supporting opportunity, according to an initial support force, a working resistance and the rigidity of the selected hydraulic support and the second support equilibrium point.

14. A computer-readable storage medium, wherein the computer-readable storage medium stores a computer program; and when the computer program is executed by a processor, the model selection method for a hydraulic support according to claim 1 is implemented.

15. A model selection system for a hydraulic support, comprising:

a stress determining device, configured to determine a first equivalent in-situ stress of a mining influence area roadway and a second equivalent in-situ stress of a non-mining influence area roadway;

an equilibrium curve determining device, configured to determine a first surrounding rock-support mutual feedback equilibrium curve under the first equivalent in-situ stress and a second surrounding rock-support mutual feedback equilibrium curve under the second equivalent in-situ stress, according to a system equation of a roadway, a function relation between a displacement of surrounding rock of the roadway and a radius of a fracture zone, the second equivalent in-situ stress, the first equivalent in-situ stress, a function relation between a first boundary stress of the fracture zone under the first equivalent in-situ stress on a softening zone and both of a first support strength required by a roadway space and the radius of the fracture zone, and a function relation between a second boundary stress of the fracture zone under the second equivalent in-situ stress on the softening zone and both of a second support strength required by the roadway space and the radius of the fracture zone;

an expansion and contraction quantity determining device, configured to determine a support strength of a to-be-selected hydraulic support on the surrounding rock and a minimum expansion and contraction quantity required by a movable column in an upright column of the hydraulic support, according to the first surrounding rock-support mutual feedback equilibrium curve, the second surrounding rock-support mutual feedback equilibrium curve, and a stress of an anchoring support of the roadway;

a residual burst energy determining device, configured to determine residual burst energy that needs to be absorbed by the hydraulic support, according to a damage variable of coal rock in the softening zone and a damage variable of coal rock in the fracture zone of the surrounding rock, a radius of the fracture zone, a radius of the softening zone, a magnitude of a most dangerous seismicity, a distance from a source of the most dangerous seismicity to a destruction point of the roadway, an equivalent radius of the roadway space, and energy consumption of the anchoring support; and a hydraulic support determining device, configured to determine the hydraulic support matched with the roadway, according to the support strength of the hydraulic support on the surrounding rock, the residual burst energy that needs to be absorbed by the hydraulic support and the minimum expansion and contraction quantity required by the movable column in the upright column.

* * * * *